US009557683B2

(12) United States Patent
Saito et al.

(10) Patent No.: US 9,557,683 B2
(45) Date of Patent: Jan. 31, 2017

(54) IMAGE FORMING APPARATUS WITH FORCED SUPPLY MODE FOR FORCEDLY SUPPLYING TONER

(71) Applicant: CANON KABUSHIKI KAISHA, Tokyo (JP)

(72) Inventors: Fumiyoshi Saito, Toride (JP); Katsuya Nose, Kashiwa (JP); Toshihisa Yago, Toride (JP); Naoki Mugita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/953,625

(22) Filed: Nov. 30, 2015

(65) Prior Publication Data

US 2016/0170327 A1 Jun. 16, 2016

(30) Foreign Application Priority Data

Dec. 12, 2014 (JP) ..... 2014-252133

(51) Int. Cl.
*G03G 15/08* (2006.01)

(52) U.S. Cl.
CPC ..... *G03G 15/0829* (2013.01); *G03G 15/0855* (2013.01); *G03G 15/0856* (2013.01); *G03G 15/0863* (2013.01); *G03G 15/0877* (2013.01)

(58) Field of Classification Search
CPC ..... G03G 15/556
See application file for complete search history.

(56) References Cited

U.S. PATENT DOCUMENTS 4,777,512 A * 10/1988 Takahashi ..... G03G 15/50 399/254
5,950,036 A * 9/1999 Konishi ..... G06F 3/1297 399/11
7,251,421 B2 * 7/2007 Yoshizuka ..... G03G 15/553 399/227
7,619,791 B2 * 11/2009 Itoyama ..... G03G 15/065 347/188

(Continued)

FOREIGN PATENT DOCUMENTS

JP 2006-201314 8/2006
JP 2006-343647 12/2006

(Continued)

*Primary Examiner* — Minh Phan
*Assistant Examiner* — Leon W. Rhodes, Jr.
(74) *Attorney, Agent, or Firm* — Fitzpatrick Cella Harper & Scinto

(57) ABSTRACT

An image forming apparatus includes an image bearing member, a developing device, a supplying device, and a controller. The controller can execute a normal supply mode and a forced supply mode on the basis of a difference between a toner supply amount in the normal supply mode and a supply amount of the toner to be supplied to the developing device. In a case where the flag is set when a predetermined time is elapsed after the difference exceeds the predetermined threshold, image formation is effected and then interrupted, and then the controller executes the operation in the forced supply mode, and in a case where the flag is reset when the predetermined time is elapsed after the difference exceeds the predetermined threshold, the image formation is effected and then said controller continues an image forming operation without executing the operation in the forced supply mode.

18 Claims, 15 Drawing Sheets

(56) References Cited

U.S. PATENT DOCUMENTS

| | | | | |
|---|---|---|---|---|
| 8,121,500 | B2 * | 2/2012 | Mitamura | G03G 15/0877 399/30 |
| 8,155,540 | B2 * | 4/2012 | Bichkar | G03G 15/0856 399/27 |
| 2005/0238369 | A1 | 10/2005 | Nakano et al. | |
| 2009/0297172 | A1 | 12/2009 | Kaji | |
| 2014/0126921 | A1 | 5/2014 | Onishi | |
| 2016/0170357 | A1 * | 6/2016 | Saito | G03G 15/0844 399/27 |

FOREIGN PATENT DOCUMENTS

| | | | |
|---|---|---|---|
| JP | 2008-111880 | | 5/2008 |
| JP | 2008111880 | A * | 5/2008 |
| JP | 2011-048201 | | 3/2011 |
| JP | 2014-095768 | | 5/2014 |

* cited by examiner

IMAGE FORMING APPARATUS WITH FORCED SUPPLY MODE FOR FORCEDLY SUPPLYING TONER

FIELD OF THE INVENTION AND RELATED ART

The present invention relates to an image forming apparatus, such as a copying machine, a printer, a facsimile machine or a multi-function machine having a plurality of functions of these machines. Particularly, the present invention relates to a constitution having an operation in a forced supply mode in which a developer is forcedly supplied after an image forming job is interrupted.

A constitution in which a supplying device for supplying a toner, in an amount corresponding to an amount of the toner consumed by image formation, from a toner bottle to a developing device is provided as a device for an image forming apparatus of an electrophotographic type has been conventionally known. As such a constitution that the supplying device is provided, in order to downsize the image forming apparatus, a constitution in which supply of the toner from each of two color toner bottles into associated developing device is made by a single motor by switching a driving path (i.e., Japanese Laid-Open Patent Application (JP-A) 2006-20134 and JP-A 2011-48201).

In the constitution including the supplying device as described above, the toner supply is made at any time during execution of an image forming job, but in the case where a toner supply amount by the toner supply during the image forming job is insufficient, in some instances, in order to maintain an image quality, the image forming job is interrupted and then the toner is forcedly supplied. Particularly, in the case of the constitution disclosed in JP-A 2006-201314 and JP-A 2011-48201, the toner supply from the two color toner bottles is made by switching the driving path of the single motor, and therefore a frequency of the toner supply for one color during the image forming job becomes small. For this reason, there is a possibility that the toner supply amount by the toner supply during the image forming job becomes insufficient.

Further, even in the case where the toner is supplied from a single color toner bottle by the single motor, when a supply frequency is high, there is a possibility that a stirring time of the toner in the developing device is short and thus a charge amount is insufficient, and therefore the number of supply times and a supply amount are limited in some cases. For this reason, also in these cases, there is a possibility that the toner supply amount by the toner supply during the image forming job becomes insufficient.

Further, it would also be considered that the number of rotation of the motor for permitting the toner supply is lowered in order to reduce noise of the image forming apparatus, but also in this case, depending on a toner consumption amount, there is a possibility that the toner supply amount by the toner supply during the image forming job becomes insufficient.

Further, in the case of either of the constitutions, an amount of the toner which can be supplied per unit time during the image forming job is limited, and therefore in the case where an image having a high image ratio is continuously formed or in the like case, there is a possibility that the toner supply amount by the toner supply during the image forming job becomes insufficient.

As described above, in the case where the toner supply amount by the toner supply during the image forming job becomes insufficient, in order to maintain the image quality, the image forming job is interrupted and then the toner is forcedly supplied, but as described below, there is also a case where a forced supply operation of the toner is not required to be executed. For example, in the case where an image for which a toner consumption amount is small (i.e., an image ratio is low) is formed immediately after the forced supply operation of the toner is executed, the insufficient toner supply amount is eliminated in some cases by this image formation even when the forced supply operation of the toner immediately before the image formation is not executed. That is, in the case where the image having the low image ratio is formed, the toner supply amount for the image formation becomes small, and therefore in some cases, the insufficient toner supply amount is eliminated by the forced supply operation performed at any time during the image forming job. In such a case, a downtime due to the forced supply operation of the toner performed after the image forming job is interrupted excessively generates. Specifically, in the case where the downtime is provided during continuous image formation and the forced supply operation of the toner is performed during the downtime, a time lag can generate from raising from an execution flag for the forced supply operation of the toner until the forced supply operation of the toner is actually executed. For example, the following case exists. FIG. 17 shows image forming timing at each of image forming stations (Yst, Mst, Cst, Kst) for yellow, magenta, cyan, black in a constitution of a so-called tandem type in which the image forming stations are arranged in a rotational direction of an intermediary transfer belt. In FIG. 17, the image forming timing at each of the image forming stations is shown along a time axis t. In this constitution, in the case where timing when an amount of the toner used every image formation is notified is image formation start timing for each of the colors, when the amount of the toner used for image formation on a first sheet at Kst is notified, image formation on a second sheet at Yst has already been started in some cases. Incidentally, the toner amount corresponds to a video count, and each of arrows in FIG. 17 represents notification timing from a controller. In this case, even if an execution flag for a forced supply operation of the toner was set during the image formation on the first sheet at Kst, the forced supply operation of the toner was not able to be executed and was executed after the image formation on the second sheet. Further, in order to ensure productivity, the controller notifies a feeding-enable signal for the second sheet to an image forming engine before the image formation on the first sheet in some cases. Also in such cases, even when the execution flag for the forced supply operation of the toner was set during the image formation on the first sheet at Yst, the feeding-enable signal for the second sheet have already been notified, and therefore the forced consumption operation of the toner was executed after the image formation on the second sheet.

However, in the case where an image small in toner consumption amount is formed in a period from the raising of the execution flag for the forced supply operation of the toner until the forced supply operation of the toner is actually executed, in some cases, the insufficient toner supply amount is eliminated without executing the forced consumption operation of the toner. In a conventional constitution, when this execution flag was set, the forced supply operation of the toner was executed irrespective of a toner consumption amount until the forced supply operation of the toner was actually executed. As described above, when the forced supply operation of the toner is excessively executed, productivity of the image formation lowers since the forced supply operation of the toner is performed after the image forming job is interrupted.

SUMMARY OF THE INVENTION

The present invention has been accomplished in view of the above-described circumferences. A principal object of the present invention is to provide an image forming apparatus capable of suppressing a lowering in productivity due to execution of an operation in a forced supply mode while maintaining an image quality in a constitution in which an operation in a forced supply mode is executable.

According to an aspect of the present invention, there is provided an image forming apparatus comprising: an image bearing member; a developing device configured to develop an electrostatic latent image, formed on the image bearing member, with a toner; a supplying device configured to supply the toner to the developing device; and a controller configured to control supply of the toner by the supplying device, wherein the controller executes an operation in a supply mode in which during a continuous image forming job for forming images on a plurality of recording materials continuously, the toner is supplied from the supplying device to the developing device without interrupting the image forming job, and executes an operation in a forced supply mode on the basis of a difference between a supply amount of the toner supplied in the operation in the supply mode and a supply amount of the toner to be supplied to the developing device, and in the operation in the forced supply mode, the controller interrupts the continuous image forming job and then forcedly supplies the toner from the supplying device to the developing device, wherein the controller includes, a difference calculating portion configured to calculate the difference, and a flag set when the difference is larger than a predetermined threshold and reset when the difference is smaller than the predetermined threshold, wherein in a case where the difference exceeds the predetermined threshold during the continuous image forming job, the controller permits image formation on a predetermined number of the recording materials from a time when the difference exceeds the predetermined threshold, and wherein in a case where the flag is set when a predetermined time is elapsed after the difference exceeds the predetermined threshold, the image formation on the predetermined number of the recording materials is effected and then interrupted, and then the controller executes the operation in the forced supply mode, and in a case where the flag is reset when the predetermined time is elapsed after the difference exceeds the predetermined threshold, the image formation on the predetermined number of the recording materials is effected and then the controller continues an image forming operation without executing the operation in the forced supply mode.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

An embodiment of the present invention will be described with reference to FIGS. 1-16. First, a general structure of an image forming apparatus in this embodiment will be described with reference to FIGS. 1-3.

[Image Forming Apparatus]

Figure 1:
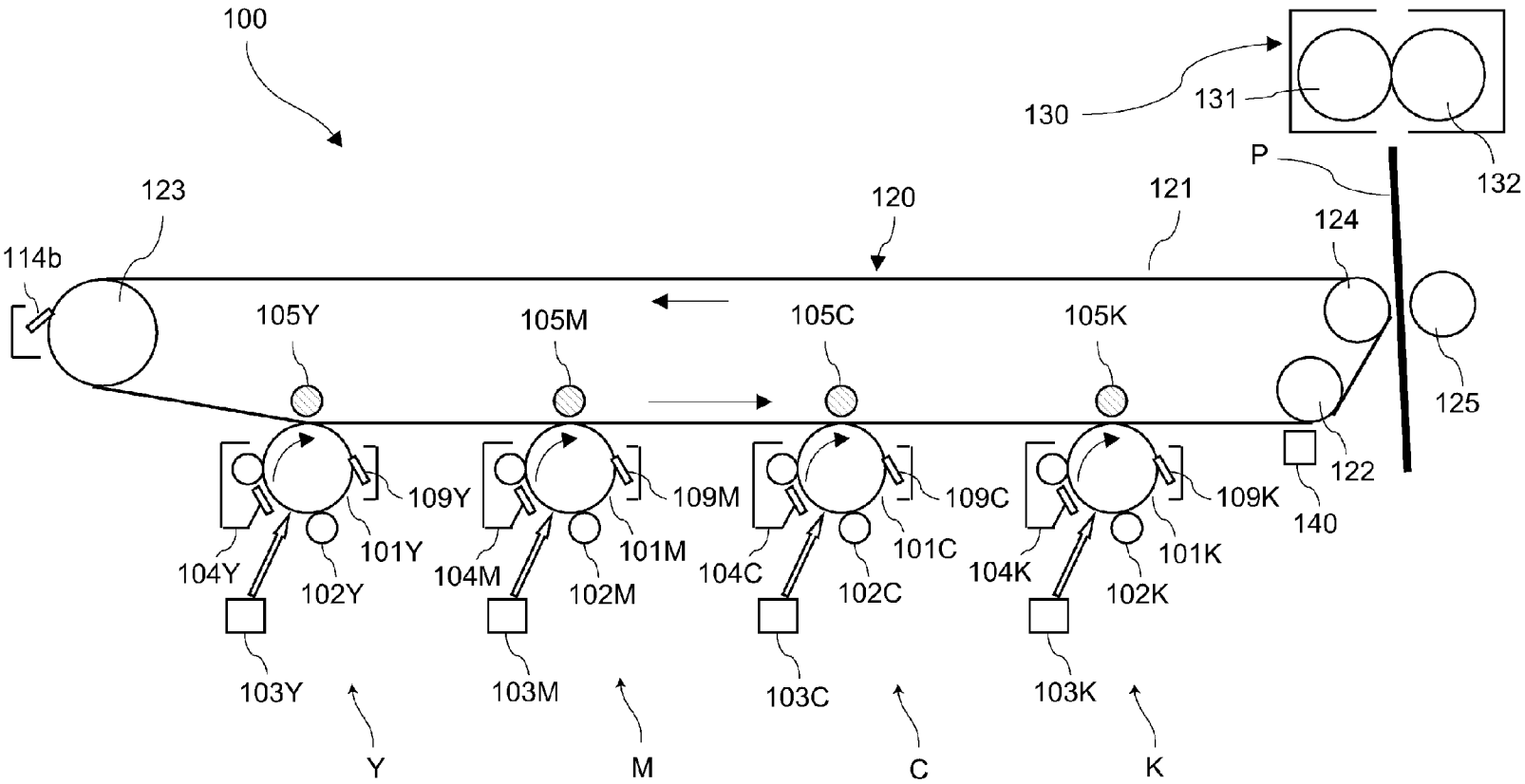
FIG. 1 is a schematic sectional view of an image forming apparatus according to an embodiment of the present invention.
Figure 2:
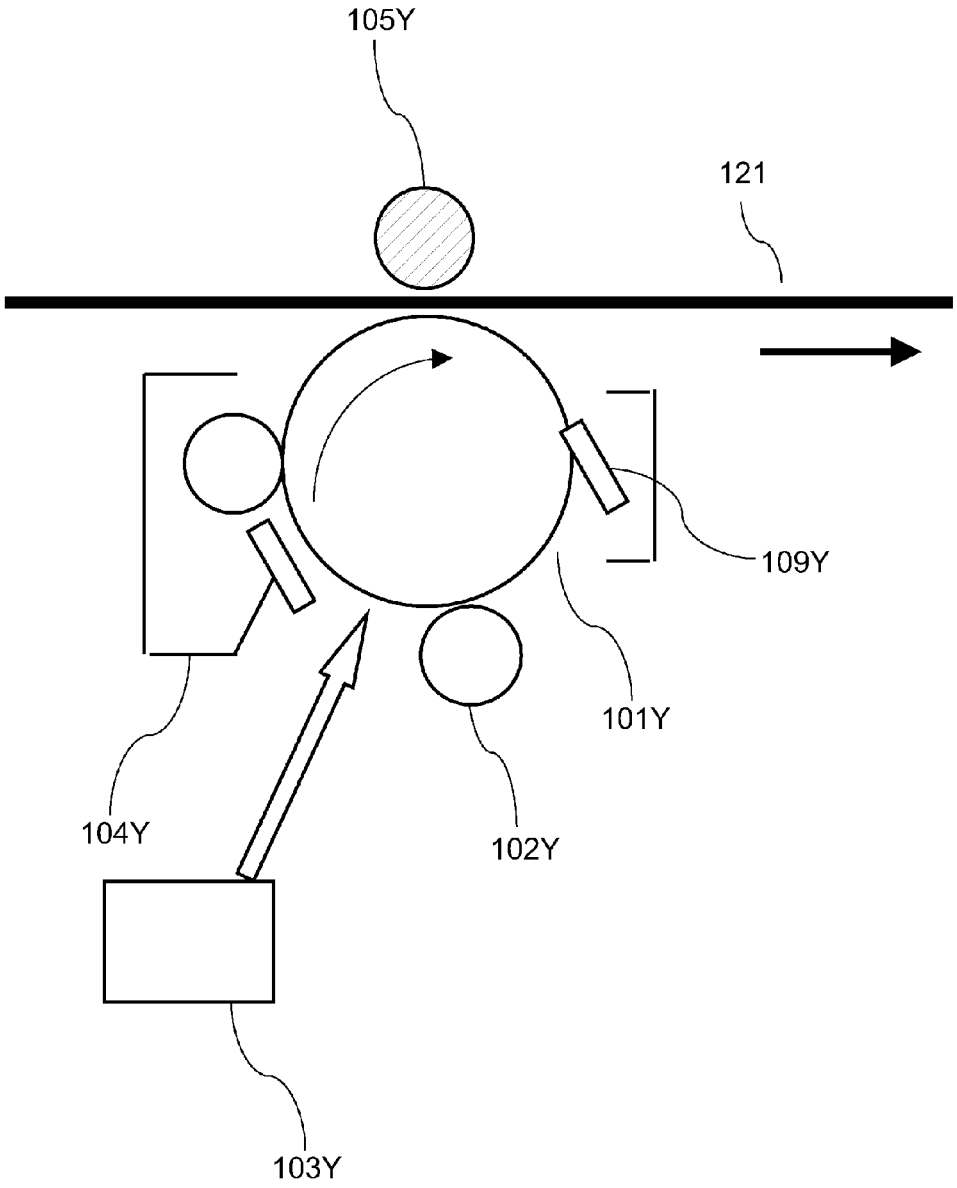
FIG. 2 is a schematic sectional view of an image forming station in the embodiment.

As shown in FIG. 1, an image forming apparatus 100 in this embodiment includes four image forming stations Y, M, C and K provided with photosensitive drums 101Y, 101M, 101C and 101K as an image bearing member. On each of the image forming stations, an intermediary transfer device 120 is disposed. The intermediary transfer device 120 is constituted so that an intermediary transfer belt 121 as an intermediary transfer member is stretched by rollers 122, 123 and 124 and is moved in a direction indicated by arrows. Constitutions around the photosensitive drums for the respective colors are similar to each other, and therefore the image forming station Y for yellow (Y) will be representatively described. Other stations will be illustrated by changing Y to suffixes representing the constitutions of the image forming stations for the respective colors.

At a periphery of the photosensitive drum 101Y, a primary charging device 102Y, a developing device 104Y, a cleaner 109Y and the like are provided. A constitution and an image forming operation at the periphery of the photosensitive drum 101Y will be described with reference to FIGS. 1 and 2.

The photosensitive drum 101Y is rotationally driven in an arrow direction. The surface of the photosensitive drum 101Y is electrically charged uniformly by the primary charging device 102Y of a charging roller type using contact charging. The surface of the charged photosensitive drum 1 is exposed to light by a laser emitting device (element) 103Y as an exposure device, so that an electrostatic latent image is formed. The thus-formed electrostatic latent image is visualized with a toner by the developing device 104Y, so that a toner image is formed on the photosensitive drum 101Y. At the image forming stations, the toner images of yellow (Y), magenta (M), cyan (C) and black (K) are formed, respectively.

The toner images formed at the respective image forming stations are transferred and superposed on the intermediary transfer belt 121 of polyimide resin by a transfer bias supplied through the primary transfer rollers 105Y, 105M, 105C and 105K. The four-color toner images formed on the intermediary transfer belt 121 are transferred onto recording material (e.g., a sheet material such as a sheet (paper) or an OHP sheet) P by a secondary transfer roller 125 as a secondary transfer means disposed opposite to the roller 124. The toner remaining on the intermediary transfer belt 121 without being transferred onto the recording material P is removed by an intermediary transfer belt cleaner 114*b*. The recording material P on which the toner images are transferred is pressed and heated by a fixing device 130 including fixing rollers 131 and 132, so that the toner image is fixed. Further, primary transfer residual toners remaining on the photosensitive drums 101 after the primary transfer are removed by cleaners 109, so that the image forming apparatus prepares for subsequent image formation.

Figure 3:
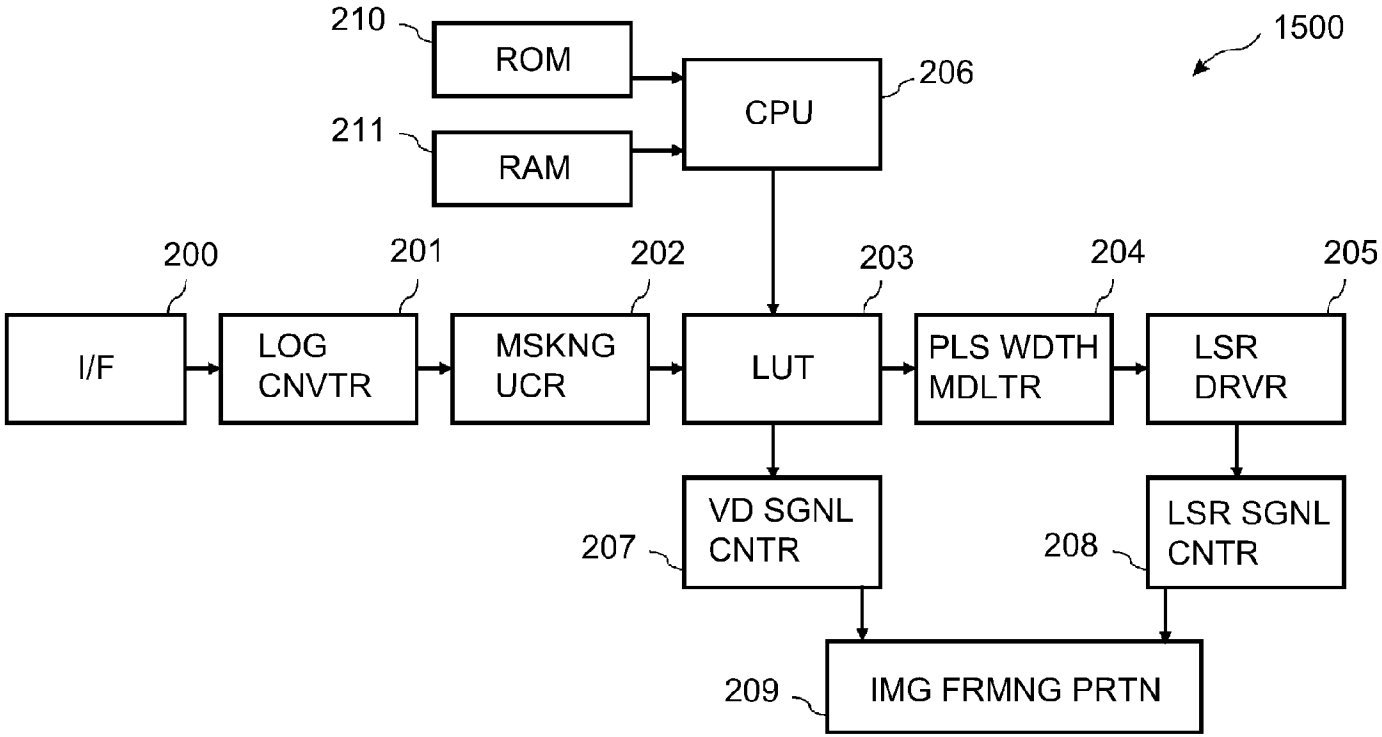
FIG. 3 is a block diagram showing a system constitution of the image forming apparatus in the embodiment.

Next, a system constitution of an image processing unit in the image forming apparatus 100 in this embodiment will be described with reference to FIG. 3. FIG. 3 shows a controller 1500 as a controller means for the image forming apparatus 100 in this embodiment. Referring to FIG. 3, through an external input interface (I/F) 200, color image data as RGB image data are inputted from an unshown external device such as an original scanner or a computer (information processing device) as desired. A LOG conversion portion 201 converts luminance data of the inputted RGB image data into CMY density data (CMY image data) on the basis of a look-up table constituted (prepared) by data or the like stored in an ROM 210. A masking UCR portion 202 extracts a black (K) component data from the CMY image data and subjects CMYK image data to matrix operation in order to correct color shading of a recording colorant. A look-up table portion (LUT portion) 203 makes density correction of the inputted CMYK image data every color by using a gamma (γ) look-up table in order that the image data are caused to coincide with an ideal gradation characteristic of a printer portion. Incidentally, the γ look-up table is prepared on the basis of the data developed on an RAM 211 and the contents of the table are set by a CPU 206. A pulse width modulation portion 204 outputs a pulse signal with a pulse width corresponding to image data (image signal) inputted from the LUT portion 203. On the basis of this pulse signal, a laser driver 205 drives the laser emitting element 103Y to irradiate the surface of the photosensitive drum 101Y with laser light, so that the electrostatic latent image is formed on the photosensitive drum 101Y.

A video signal count portion 207 adds up a level for each pixel (0 to 255 level) for a screenful of the image (with respect to 600 dpi in this embodiment) of the image data inputted into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal count portion 207, the image signal from the laser driver 205 is similarly calculated, so that it is possible to obtain the video count value.

The image forming portion 209 drive-controllers a constitution of each of the respective portions of the respective image forming stations described above. For example, the laser driver 205 drives the laser emitting element 103Y via the image forming portion 209 by a pulse signal on the basis of the image data. The CPU 206 causes the image forming portion 209 to execute an operation in a forced supply mode as described later on the basis of information such as a video count value obtained by the video signal count portion 207.

[Developing Device]

Figure 4:
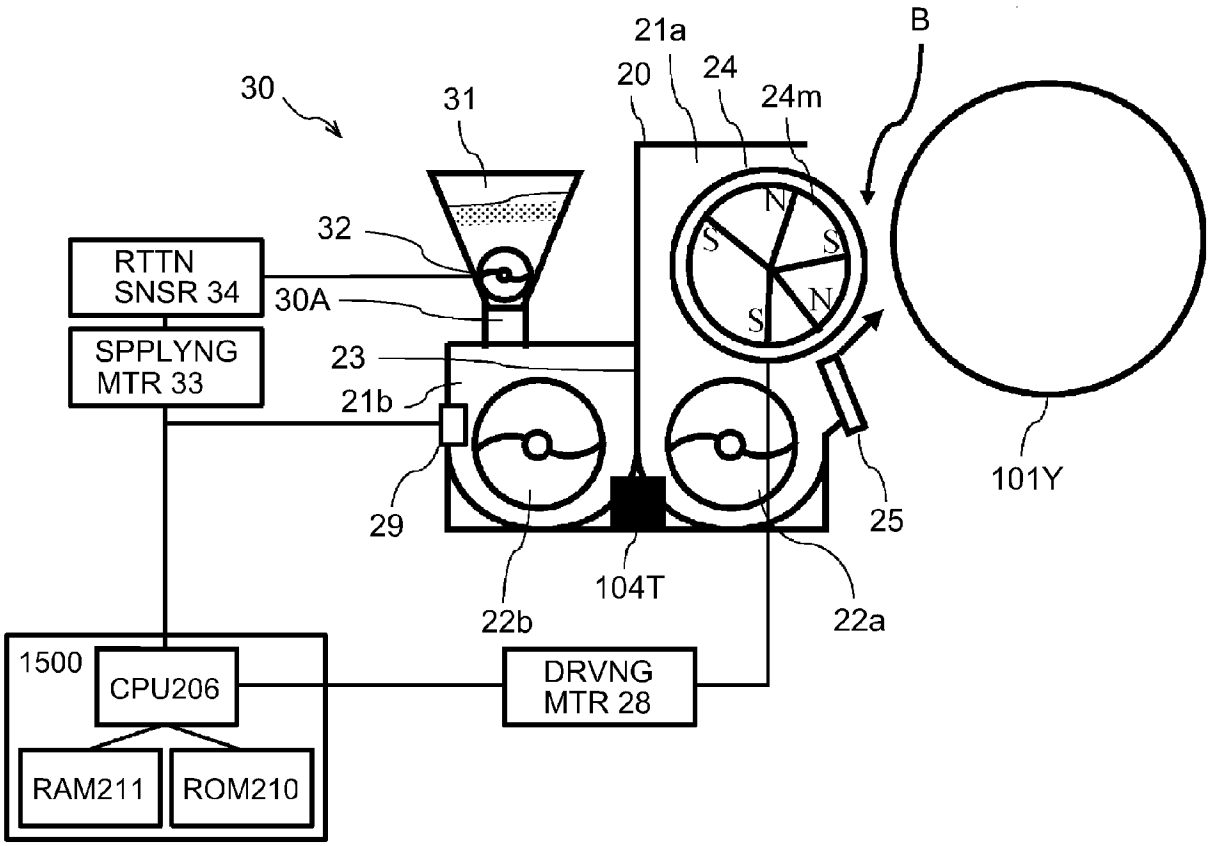
FIG. 4 is a schematic cross-sectional view of a developing device in the embodiment.
Figure 5:
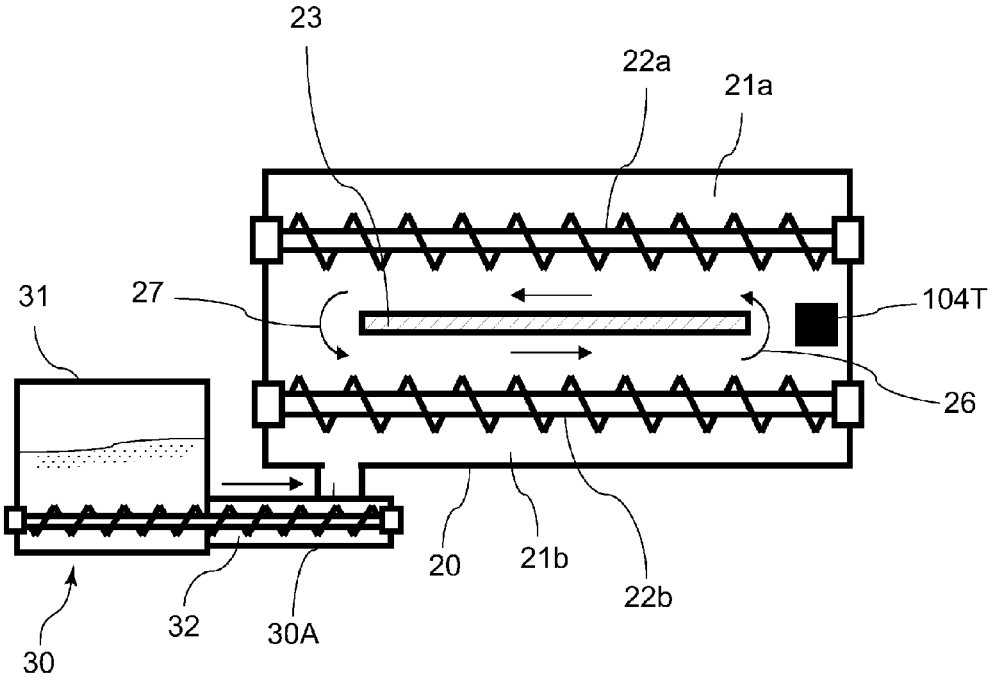
FIG. 5 is a schematic longitudinal sectional view of the developing device in the embodiment.
Figure 6:
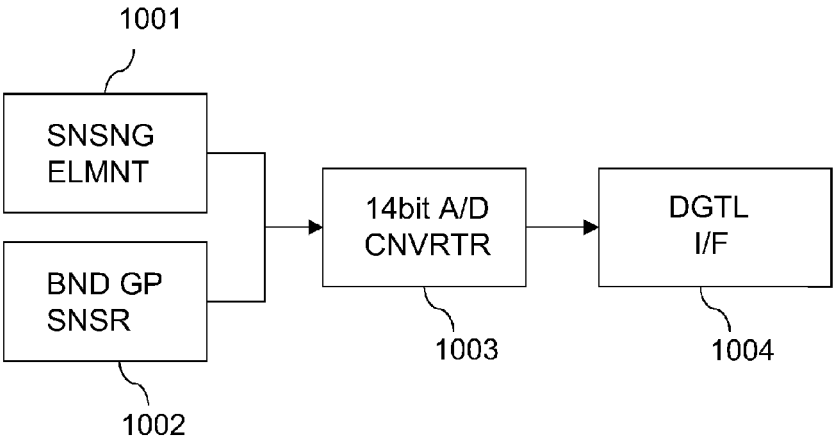
FIG. 6 is a control block diagram of a temperature sensor provided in the developing device in the embodiment.

The developing device 104Y in this embodiment will be further described specifically with reference to FIGS. 4-6. Incidentally, the developing devices at other image forming stations have the same constitution as the developing device 104Y, and therefore in the following description, the developing device 104Y for the image forming station Y will be representatively described. The developing device 104Y in this embodiment includes a developing container 20, in which a two component developer including a toner and a carrier is stored. The developing device 104 also includes a developing sleeve 24 as a developer carrying means and a trimming (chain-cutting) member 25 for regulating a magnetic brush chain formed of the developer carried on the developing sleeve 24, in the developing container 20.

The inside of the developing container 20 is horizontally divided by a partition wall 23 into a developing chamber 21*a* and a stirring chamber 21*b*. The partition wall 23 extends in the direction perpendicular to the drawing sheet of FIG. 4. The developer is stored in the developing chamber 21*a* and the stirring chamber 21*b*. In the developing chamber 21*a* and the stirring chamber 21*b*, first and second feeding screws 22*a* and 22*b* which are feeding members as developer stirring and feeding means are disposed, respectively. As shown in FIG. 5, the first feeding screw 22*a* is disposed, at the bottom portion of the developing chamber 21*a*, roughly in parallel to the axial direction of the developing sleeve 24. It conveys the developer in the developing chamber 21*a* in one direction along the axial direction of the developing sleeve 24 by being rotated. The second feeding screw 22*b* is disposed, at the bottom portion of the stirring chamber 21*b*, roughly in parallel to the first feeding screw 22*a*. It conveys the developer in the stirring chamber 21*b* in the direction opposite to that of the first feeding screw 22*a*. The second feeding screw 22*b* stirs and feeds a toner supplied from a hopper 31 and the developer which has already been contained in the developing container 20, so that a toner content (concentration) in the developer is uniformized.

Thus, by the feeding of the developer through the rotation of the first and second feeding screws 22*a* and 22*b*, the developer is circulated between the developing chamber 21*a* and the stirring member 21*b* through openings 26 and 27 (that is, communicating portions) present at both ends of the partition wall 23 (FIG. 5). The first and second feeding screws and the developing sleeve described specifically later are driven by a developing(-device) driving motor 28. In this embodiment, the developing chamber 21*a* and the stirring chamber 21*b* are horizontally disposed. However, the present invention is also applicable to a developing device in which the developing chamber 21*a* and the stirring chamber 21*b* are vertically disposed and developing devices of other types.

The developing container 20 is provided with an opening at a position corresponding to a developing region B wherein the developing container 20 opposes the photosensitive drum 101Y. At this opening, the developing sleeve 24 is rotatably disposed so as to be partially exposed toward the photosensitive drum 101Y. In this embodiment, the diameters of the developing sleeve 24 and the photosensitive drum 101Y are 20 mm and 30 mm, respectively, and a distance in the closest area between the developing sleeve 24 and the photosensitive drum 101Y is about 300 μm. By this constitution, development can be effected in a state in which the developer fed to the developing region B is brought into contact with the photosensitive drum 101Y.

Incidentally, the developing sleeve 24 is formed of nonmagnetic material such as aluminum and stainless steel and inside thereof a magnetic roller 24*m* as a magnetic field generating means is non-rotationally disposed.

In the constitution described above, the developing sleeve 24 is rotated in the direction indicated by an arrow (counterclockwise direction) to carry the two component developer regulated in its layer thickness by cutting of the chain of the magnetic brush with the trimming member 25. Then, the developing sleeve 24 conveys the layer thickness-regulated developer to the developing region B in which the developing sleeve 24 opposes the photosensitive drum 101Y, and supplies the developer to the electrostatic latent image formed on the photosensitive drum 101Y, thus developing the latent image. At this time, in order to improve development efficiency, i.e., a rate of the toner imparted to the latent image, a developing bias voltage in the form of a DC voltage biased or superposed with an AC voltage is applied to the developing sleeve 24 from a power (voltage) source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

In the two component magnetic brush developing method, generally, the application of AC voltage increases the development efficiency and therefore the image has a high quality but on the other hand, fog is liable to occur. For this reason, by providing a potential difference between the DC voltage applied to the developing sleeve 24 and the charge potential of the photosensitive drum 101Y (i.e., a white background portion potential), the fog is prevented.

The trimming member (regulating blade) 25 is constituted by a nonmagnetic member formed with an aluminum plate or the like extending in the longitudinal axial direction of the developing sleeve 24. The trimming member 25 is disposed upstream of the photosensitive drum 101Y with respect to the rotational direction of the developing sleeve 24. Both the toner and the carrier of the developer pass through the gap between a free end of the trimming member 25 and the developing sleeve 24 and are sent into the developing region B.

Incidentally, by adjusting the gap between the trimming member 25 and the surface of the developing sleeve 24, the trimming amount of the magnetic brush chain of the developer carried on the developing sleeve 24 is regulated, so that the amount of the developer sent into the developing region B is adjusted. In this embodiment, a coating amount per unit area of the developer on the developing sleeve 24 is regulated at 30 mg/cm$^2$ by the trimming member 25.

The gap between the trimming member 25 and the developing sleeve 24 is set at a value in the range of 200-1,000 μm, preferably, 300-700 μm. In this embodiment, the gap is set at 500 μm.

Further, in the developing region B, the developing sleeve 24 of the developing device 104Y moves in the same direction as the movement direction of the photosensitive drum 101Y at a peripheral speed ratio of 1.80 by which the developing sleeve 24 moves at the peripheral speed which is 1.80 times that of the photosensitive drum 101Y. With respect to the peripheral speed ratio, any value may be set as long as the set value is in the range of 0-3.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

Further, at the opening (communicating portion) 26 in the developing container 20, as a temperature detecting means for the developer, a temperature sensor 104T is disposed. The disposition place of the temperature sensor 104T in the developing container 20 may desirably be a position in which a sensor surface is buried in the developer in order to improve detection accuracy.

Here, the temperature sensor 104T will be described more specifically with reference to FIG. 6. In this embodiment, as the temperature sensor 104T, a temperature/humidity sensor ("SHT1X series", mfd. by Sensirion Co., Ltd.) was used. The temperature sensor 104T includes a sensing element 1001 of an electrostatic capacity polymer as a humidity detecting device and includes a band gap temperature sensor 1002 as a temperature detecting device. The temperature sensor 104T is a CMOS device having such a specification that outputs of the sensing element 1001 and band gap temperature sensor 1002 are coupled by a 14 bit-A/D converter 1003 and serial output is performed through a digital interface 1004.

The band gap temperature sensor 1002 as the temperature detecting device uses a thermistor linearly changing in resistance value with respect to the temperature and calculates the temperature from the resistance value. Further, the sensing element 1001 as the humidity detecting device is a capacitor in which a polymer is inserted as a dielectric member. The sensing element 1001 detects the humidity by converting the electrostatic capacity into the humidity by utilizing such a property that the content of water which is adsorbed by the polymer is changed depending on the humidity and as a result, the electrostatic capacity of the capacitor linearly changes with respect to the humidity. The temperature sensor 104T used in this embodiment can detect both of the temperature and the humidity. However, actually, only a detection result of the temperature is utilized, so that the use of other sensors capable of detecting only the temperature may also be sufficient.

[Supply of Developer]

A supplying method of the developer in this embodiment will be described with reference to FIGS. 4 and 5. At an upper portion of the developing device 104Y, a toner supplying device 30 as a supplying means for supplying the toner to the developing device 104Y depending on a consumption amount of the developer is provided. The toner supplying device 30 includes a hopper 31 accommodating a two-component developer for supply in which the toner and a carrier are mixed (ordinarily in a (toner/developer for supply) ratio of 100% to 80%). The hopper 31 includes a screw-shaped supplying member, i.e., a supplying screw 32 at a lower portion thereof, and an end of the supplying screw 32 extends to a position of a developer supplying opening 30A provided at a rear end portion of the developing device 104Y. The supplying screw 23 is rotationally driven by a supplying motor 33.

The toner in an amount corresponding to an amount of the toner consumed by the image formation is passed from the hopper 31 through the developer supplying opening 30A and is supplied into the developing device 104Y by a rotational force of the supplying screw 32 driven by the supplying motor 33 and the force of gravitation of the developer. In rotation controller of the supplying motor 33, the rotation of the supplying screw 32 is detectable in one rotation unit by a rotation detecting sensor 34 such as encoder as a rotation detecting means and is controlled by the CPU 206 so that the supplying motor 33 is driven corresponding to the number of predetermined times of rotation. At an upper portion of the hopper 31, an unshown sensor for detecting the presence or absence of the toner in the hopper is provided, so that the presence or absence of the toner in the hopper 31 can be discriminated. In the stirring chamber 21*b*, the inductance sensor 29 as the toner content detecting means for detecting the toner content in the developing device (developing container 20) is provided. The inductance sensor 29 is capable of detecting a TD ratio, as the toner content in the developer, which is a ratio between the toner and the carrier in the developing container 20. The amount of the developer for supply to be supplied from the hopper 31 into the developing device 104 is roughly determined by the number of rotation of the supplying screw 32. This number of rotation is determined by the controller 1500 on the basis of a video count value of the image data, a detection result of an inductance sensor 29 as a toner content (concentration) detecting means provided in the developing container 20, or the like.

Here, the two component developer, which comprises the toner and the carrier, stored in the developing container 20 will be described more specifically.

The toner contains primarily binder resin, and coloring agent. If necessary, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size. Further, as the toner in recent years, a toner having a low melting point or a toner having a low glass transition point Tg (e.g., ≤70° C.) is used in many cases in order to improve a fixing property. In some cases, in order to further improve the fixing property, a wax is incorporated in the toner. The developer in this embodiment contains a pulverization toner in which the wax is incorporated.

As for the material for the carrier, particles of iron, the surface of which has been oxidized or has not been oxidized, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm·cm, preferably, not less than $10^8$ ohm·cm, in resistivity. In this embodiment, the carrier with a resistivity of $10^8$ ohm·cm was used.

Incidentally, the volume-average particle size of the toner used in this embodiment was measured by using the following device and method. As the measuring device, a sheath-flow electric resistance type particle size distribution measuring device ("SD-2000", manufactured by Sysmex Corp.) was used. The measuring method was as follows. To 100-150 ml of an electrolytic solution which is a 1%-aqueous NaCl solution prepared using reagent-grade sodium chloride, 0.1 ml of a surfactant as a dispersant, preferably, alkylbenzenesulfonic acid salt, was added, and to this mixture, 0.5-50 mg of a measurement sample was added.

Then, the electrolytic solution in which the sample was suspended was dispersed for about 1-3 minutes in an ultrasonic dispersing device. Then, the particle size distribution of the sample, the size of which is in the range of 2-40 μm was measured with the use of the above-mentioned measuring device ("SD-2000") fitted with a 100 μm aperture, and the volume-average distribution was obtained. Then, a volume-average particle size was obtained from the thus-obtained volume-average distribution.

Further, the resistivity of the carrier used in this embodiment was measured by using a sandwich type cell with a measurement electrode area of 4 $cm^2$ and a gap between two electrodes of 0.4 cm. A voltage E (V/cm) was applied between the two electrodes while applying 1 kg of weight (load) to one of the electrodes, to obtain the resistivity of the carrier from the amount of the current which flowed through the circuit.

[Supply Controller of Developer]

Figure 7:
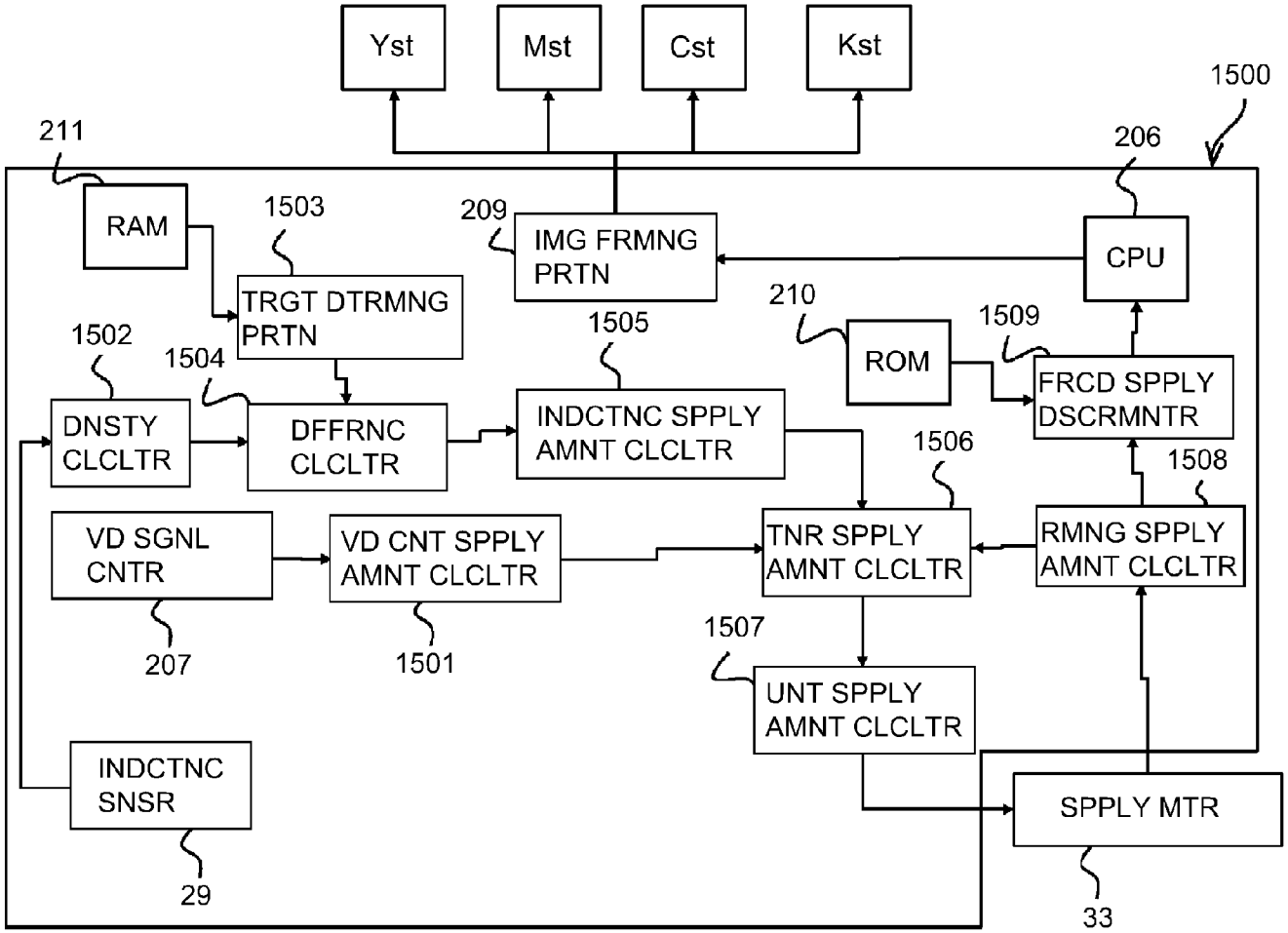
FIG. 7 is a block diagram of toner supply controller of the image forming apparatus in the embodiment.

Supply controller of the developer (toner) in this embodiment will be described using FIG. 7. In this embodiment, the toner supply by the toner supplying device 30 is controlled by the controller 1500 as the controller means shown in FIG. 7. In the following description, the case where the toner is supplied as the developer will be described, but this is also true for the case where the toner and the carrier are supplied as the developer. In FIG. 7, Yst, Mst, Cst and Kst represent the image forming stations, Y, M, C and K, respectively, controlled by the image forming portion 209.

During execution of an image forming job, the toner content in the developer in the developing device 104Y is lowered by the development of the electrostatic latent image. That is, when the image formation is effected, the toner is consumed, so that the TD ratio which is the ratio between the toner and the carrier in the developing container 20 changes. A charging characteristic of the toner varies depending on the value of the TD ratio, and therefore in order to maintain the charging property of the toner, during the image forming job, an operation in a normal supply mode in which the toner is supplied by the above-described toner supplying device 30 is executed at any time. As a result, the toner content in the developing container 20 is maintained in a predetermined range, so that an image quality is stabilized.

Here, the image forming job is a series of operations performed as described below on the basis of a print instruction signal (image formation instruction signal). That is, the image forming job is a series of operations from start of a preparatory operation (so-called pre-rotation operation) required for effecting the image formation until a preparatory operation (so-called post-rotation operation) required for ending the image formation after an image forming step is performed. Specifically, the image forming job refers to the operations from the pre-rotation operation (preparatory operation before the image formation) after the print instruction signal is sent (the image forming job is inputted) to the post-rotation operation (operation after the image formation), and includes an image forming period and a sheet (paper) interval (non-image formation period). However, the pre-rotation operation and the post-rotation operation can be omitted in the case where the image forming job is continuously inputted or in the case where a subsequent image forming job is inputted during execution of the image forming job. For example, the case where an image formation instruction including a first image forming job for 10 sheets of plain paper and 2 sheets of thick paper and a second image forming job for 5 coated paper is inputted will be considered. In this case, at least one of the post-rotation operation of the first image forming job and the pre-rotation operation of the second image forming job may be omitted.

In this embodiment, a toner supply amount is calculated on the basis of two pieces of information as described below and then the toner supply is made at any time during the execution of the image forming job. In the operation in the normal supply mode in this embodiment, during the execution of the image forming job (e.g., during the drive of the developing driving motor 28), calculation of the toner supply amount is made at any time irrespective of every image formation, so that also toner supply is made at any time. However, the calculation of the toner supply amount and the toner supply may also be made every image formation. In summary, the operation in the normal supply mode is controller effected during the execution of the job without interrupting the image forming job. In the following, the toner supply amount during the image formation will be described.

First, as a first piece of information for calculating the toner supply amount, a video count Vc obtained from image information of an output product of an N-th sheet is calculated by a video signal count portion 207. The video count value Vc corresponds to a consumption value depending on an amount of the toner consumed every predetermined unit of the image formation. The predetermined unit of image formation is a unit, set for effecting the image formation, such as a single A4-sized recording material. The predetermined unit with respect to the size and the number of sheets is not limited thereto, but may also be any size such as A3 or B5, and may also be appropriately set depending on the size or status of use, such as ½ sheet or plural sheets, principally used in the image forming apparatus. In this embodiment, one sheet of the A4-sized recording material is used as the predetermined unit (of image formation).

Then, at a video count supply amount calculating portion 1501, a video count supply amount M(Vc) which is a toner supply amount based on the video count value is calculated according to the following formula 1 by multiplying the calculated video count value by a coefficient A(Vc). That is, the video count amount calculating portion 1501 calculates the toner supply amount on the basis of a consumption amount Vc depending on the amount of the toner consumed every predetermined unit of the image formation.

$$M(Vc)=Vc\times A(Vc) \quad \text{(formula 1)}$$

Here, the video count value Vc when the image having the image ratio of 100% (whole surface solid image) is outputted is 1023 and varies depending on the image ratio.

Next, as a second piece of the information for calculating the toner supply amount, on the basis of a detection result of the inductance sensor 29 at an N−1th sheet, TD(Indc) which is the TD ratio in the developing container 20 is calculated by a toner content calculating portion 1502. Then, a difference value ΔTD(Indc) between the TD(Indc) and TD(target) which is a target TD ratio determined by a toner content target value determining portion 1503 is calculated at a difference calculating portion 1504 as a toner content difference calculating means. That is, the difference ΔTd(Indc) between the toner content TD(Indc) detected by the inductance sensor 29 and the target value TD(target) is calculated. Then, at an inductance supply amount calculating portion 1505, by multiplying this ΔTD(Indc) by a coefficient A(Indc), an inductance supply amount M(Indc) which is the toner supply amount based on the toner content is calculated according to the following formulas 2 and 3.

$$M(\text{Indc})=-\Delta TD(\text{Indc})\times A(\text{Indc}) \quad \text{(formula 2)}$$

$$\Delta TD(\text{Indc})=TD(\text{Indc})-TD(\text{target}) \quad \text{(formula 3)}$$

The above-described coefficients A(Vc) and A(Indc) are coefficients set depending on the image forming apparatus and are recorded in ROM 210 in advance.

Further, the TD(target) which is the target TD ratio is recorded in the RAM 211, and a set value can be changed. A changing method of the TD(target) in this embodiment is such that an image density detecting image pattern (patch image) for reference is formed and an image density thereof is detected by an image density sensor 140 (FIG. 1) disposed opposed to the intermediary transfer belt 121 and then the TD(target) is changed depending on a result of the detection. However, the changing method of the TD(target) is not limited thereto, but the TD(target) may also be changed by another method.

A toner supply amount calculating portion 1506 as a calculating means calculates a toner supply amount M to be supplied to the developing device according to the following formula 4 from the video count supply amount M(Vc) and the inductance supply amount M(Indc) which are described above. That is, the toner supply amount M is calculated by adding the value M(Indc), depending the difference ΔTD (Indc) calculated by the difference calculating portion 1504, to the value M(Vc) depending on the consumption value Vc based on the amount of the toner consumed by the image formation.

$$M=M(Vc)+M(\text{Indc})+M(\text{remain}) \quad \text{(formula 4)}$$

Here, M(remain) is a remaining supply amount of the toner remaining in the supplying device 30 without being supplied. The reason why the remaining supply amount generates is that the supplying screw 32 carries out the supply on one rotation unit basis and therefore a supply amount less than the amount corresponding to one rotation is integrated. Details thereof will be described later. In the formula 4, in the case of M<0, M=0 is set. Further, from the formula 4, even when M(Indc) is 0, in the case where the image ratio is high or the remaining supply amount is large, the supply is made in some instances.

Then, at a unit supply amount calculating portion 1507, a required number of times of rotation Brq of the supplying motor 33 will be calculated from the toner supply amount M calculated as described above. That is, when the supplying screw 32 rotates one full turn, an amount T supplied to the inside of the developing container 20 is recorded in the ROM 210 in advance, and from the calculated toner supply amount M, the required number of times of rotation Brq of the supplying screw 32 is calculated by the following formula 5.

$$Brq=M/T \quad \text{(formula 5)}$$

The fractional portion of Brq is discarded, and only an integer portion is used. In this embodiment, setting of T=0.10 g is made.

Further, in this embodiment, at the unit supply amount calculating portion 1507, in contrast to the required number of times of rotation Brq, an executed number of times of rotation Bpr which the number of times of rotation by which the toner is actually supplyable is calculated. A calculating method will be described later. The supplying motor 33 is rotated correspondingly to the executed number of times of rotation Bpr, so that the toner supply is made. The above is the operation in the normal supply mode in this embodiment, and such controller is executable by the CPU 206 also as a normal executing means.

On the other hand, at a remaining supply amount calculating portion 1508, with respect to the toner supply amount M calculated as described above, the amount of the toner which cannot be supplied is calculated as the remaining supply amount M (remain) by the following formula 6. That is, a difference (remaining supply amount) between the toner supply amount calculated by the toner supply amount calculating portion 1506 and the supply amount of the toner supplied in the operation in the normal supply mode is calculated.

$$M(\text{retain})=M-Bpr\times T \quad \text{(formula 6)}$$

Further, at a forced supply discriminating portion 1509, on the basis of the remaining supply amount M(retain), whether or not a forced supply mode execution condition described later is satisfied is discriminated. In the case where the forced supply mode execution condition is satisfied, the forced supply flag is set, i.e., a predetermined signal is stored in the RAM 211 as the storing means, notification to the CPU 206 is made.

[Forced Supply Mode]

Next, the operation in the forced supply mode in this embodiment will be described. First, an outline of enabling or disabling of execution of the operation in the forced supply mode will be described. As described above, according to this embodiment, from the toner supply amount M, the executed number of times of rotation Bpr of the supplying motor 33 is calculated, and then the toner supply in the operation in the normal supply mode is executed. Here, in this embodiment, for the purposes of reductions in size, noise and cost of the supplying motor 33, for formation of the image on one sheet of the A4-sized recording material, the supplying motor 33 is set at a rotational speed where the supplying motor 33 can rotate only up to 2 full turns. Specifically, a time required for outputting one sheet of the A4-sized recording material by the image forming apparatus 100 during the continuous image formation is 2.4 sec. On the other hand, the rotational speed of the supplying motor 33 is set so that the rotational speed of the supplying screw 32 is 60 rpm, and therefore the supplying motor 33 can only be rotated one full turn per 1 sec. For this reason, in this embodiment, for formation of the image on one sheet of the A4-sized recording material, the supplying motor 33 can be rotated only up to the 2 full turns. That is, in this embodiment, a predetermined amount of the toner capable of being supplied by the toner supplying device 30 per unit time (per one sheet of the A4-sized recording material) during the image forming job is an amount corresponding to the 2 full turns of the supplying motor 33.

Further, in this embodiment, the toner consumption amount during output of the whole surface solid image of 100% in image ratio on the A4-sized recording material is about 0.35 g, whereas the toner consumption amount when the supplying screw 32 rotates one full turn is about 0.10 g. As described above, during the image formation on one sheet of the A4-sized recording material, the supplying screw 32 can be rotated only up to the 2 full turns, and therefore a maximum supply amount is 0.20 g, so that the supply amount is 0.15 g short of the image formation on one sheet. Accordingly, in the operation in the normal supply mode, an amount (remaining supply amount) corresponding to this 0.15 g cannot be supplied in the operation in the normal supply mode, and therefore when the remaining supply amount is not less than a predetermined threshold, the CPU 206 also as a forced executing means raises a forced supply flag and executes the operation in the forced supply mode at predetermined timing described later. That is, in this embodiment, at predetermined timing after a difference between the supply amount of the toner supplied in the operation in the normal supply mode and the supply amount of the toner to be supplied to the developing device becomes not less than the predetermined threshold, the operation in the forced supply mode in which the image forming job is interrupted and then the toner is forcedly supplied is executable.

In view of this above, the operation in the forced supply mode in this embodiment will be described in comparison with Comparison Example. Incidentally, in Comparison Example, when the forced supply flag is set, the operation in the forced supply mode is executed irrespective of the toner consumption amount in a period until the operation in the forced supply mode is actually executed, and in this embodiment, execution of the operation in the forced supply mode is interrupted depending on the toner consumption amount during this period.

[Comparison Example]

First, a flow of discrimination whether or not the operation in the forced supply mode in Comparison Example can be executed will be described using FIG. 8 while making reference to FIG. 7. When the image formation is started, the video signal count portion 207 calculates the video count value Vc, and an output of the inductance sensor 29 is detected (S1). Then, at the toner supply amount calculating portion 1506, the toner supply amount M is calculated by the formula 4 (S2). Then, the required number of times of rotation Brq of the supplying screw 32 is calculated by the formula 5 (S3). Then, from a calculated value of the required number of times of rotation Brq, the number of times of rotation (executed number of times of rotation) Bpr by which the unit supply amount calculating portion 1507 is capable of actually supplying the toner is calculated. Specifically, whether or not Brq is larger than 2 is discriminated (S4), and in the case where Brq is larger than 2, Bpr is set at 2 (S5). On the other hand, Brq is not more than 2, Bpr=Brq is set (S6). Then, depending on the calculated value of Bpr, the toner supply is made by rotating the supplying screw 32 by Bpr time(s) during the image forming job (S7).

That is, in the case where the toner supply amount M (corresponding to Brq in this case) calculated by the toner supply amount calculating portion 1506 is not more than the predetermined amount (not more than 2) of the toner supplyable per the image on one sheet of the A4-sized recording material, the toner in the calculated toner supply amount Bpr (=Brq) is supplied during the image forming job. On the other hand, in the case where the toner supply amount Brq is larger than the predetermined amount (=2), the toner in the predetermined amount Bpr (=2) is supplied during the image forming job.

Then, the remaining supply amount M (remain) of the toner which cannot be supplied for the image formation of the image on one sheet of the A4-sized recording material is calculated by the formula 6 (S8). Then, at the forced supply discriminating portion 1509, the presence or absence of the forced supply flag described later is checked (S9), and in the case where the forced supply flag is not set, whether or not the calculated remaining supply amount M (remain) satisfies a relationship of the following formula 7 (S10). That is, whether or not the difference (remaining supply amount M(retain)) calculated by the remaining supply amount calculating portion 1508 is not less than the predetermined threshold (not less than a remaining supply amount threshold M(supply)).

$$M(\text{remain}) \geq M(\text{supply}) \quad \text{(formula 7)}$$

In the case where the formula 7 is not satisfied, i.e., the remaining supply amount M(remain) is less than the remaining supply amount threshold M(supply), the sequence is returned to S1, and then the image formation is continued. In this case, the remaining supply amount M(retain) is used during the calculation of the toner supply amount M during subsequent image formation. On the other hand, in the case where the formula 7 is satisfied, i.e., the remaining supply amount M(remain) is not less than the remaining supply amount threshold M(supply), a predetermined signal is stored in the RAM 211, i.e., the forced supply flag is set (S11). That is, in this case, there is a need to supply the toner in an amount short in the operation in the normal supply mode by executing the operation in the forced supply mode, and therefore the forced supply flag for executing the operation in the forced supply mode. Here, M(supply) is the remaining supply amount threshold for discriminating whether or not the operation in the forced supply mode should be executed, and is stored in the ROM 210 in advance. In this embodiment, M(supply)=0.70 g is employed, but may also be set at another value. The value of M(supply) is determined in consideration of the influence, such as a lowering in image density, due to failure in toner supply.

Then, the CPU 206 discriminates whether or not the timing is execution timing of the operation in the forced supply mode (S12). That is, even when the forced supply flag is set, in some cases, execution of the operation in the forced supply mode after the image forming job is interrupted cannot be made immediately.

For example, assuming that the remaining supply amount M(remain) in the developing device 104K for K increases and is larger than the remaining supply amount threshold M(supply), and the forced supply flag is set, when the image at the time when the forced supply flag is set is final image, the operation in the forced supply mode is executable as it is. However, in the case where the continuous image formation is in progress, when the forced supply flag for the developing device 104K for K is set, at the image forming station Y for Y, a subsequent image forming operation has already been continued. For this reason, in order to prevent the Y toner with which the image formation is started from being useless, the image forming job cannot be interrupted immediately, and therefore even after the forced supply flag for K is set, the image formation is effected also with respect to a subsequent image which has already been subjected to the image formation. Accordingly, even when the forced supply flag is set, a time lag generates in some cases until the operation in the forced supply mode is executed. In Comparison Example, it is assumed that there is a time lag correspond to image formation on two sheets from the raising of the forced supply flag to the execution of the operation in the forced supply mode.

For this reason, in the step S12, in the case where the forced supply flag is set in the step S9 or S11, whether or not the timing is timing (predetermined timing) when the operation in the forced supply mode is executable is checked. If the timing is not the predetermined timing, the operation in the forced supply mode is not executed, and the image formation is continued (S13). Here, in the case where the operation in the forced supply mode is not executed, the toner supply amount calculating portion 1506 uses the remaining supply amount M(remain) during the calculation of the toner supply amount for subsequent image formation. Specifically, the remaining supply amount M(remain) calculated by the remaining supply amount calculating portion 1508 is added during calculation of subsequent toner supply amount to calculate the toner supply amount M of the toner to be supplied to the developing device. On the other hand, if the timing is the predetermined timing, the image forming job is interrupted and then the operation in the forced supply mode is executed (S14). The operation in the forced supply mode will be described later. When the operation in the forced supply mode is executed in the step S14, the image formation is resumed (S15).

[Operation in Forced Supply Mode]

Figure 9:
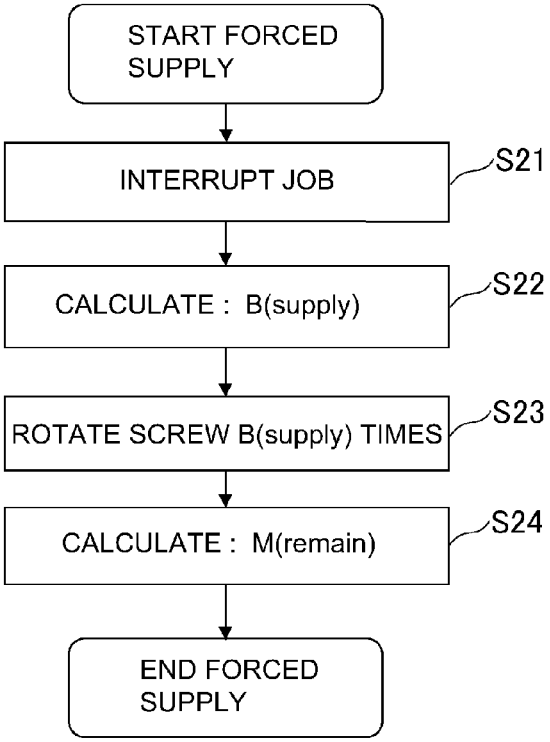
FIG. 9 is a flowchart showing an operation in the forced supply mode in Comparison Example and in the embodiment.
Figure 10:
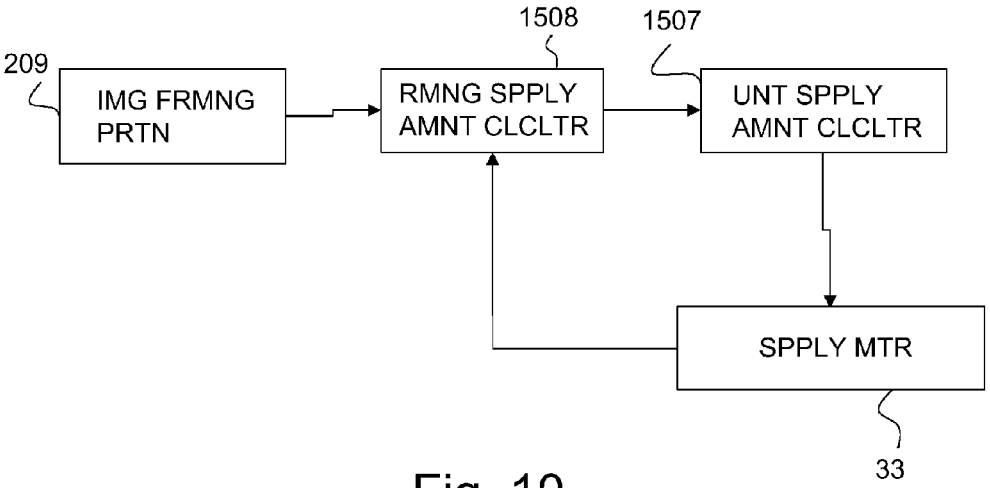
FIG. 10 is a block diagram of forced supply controller of a toner in the image forming apparatus in the embodiment.

The operation in the forced supply mode will be described with reference to FIGS. 9 and 10. In the above-described step S12 of FIG. 8, in the case where the timing is the predetermined timing when the operation in the forced supply mode is executable, the CPU 206 notifies the timing to the image forming portion 209 and temporarily interrupts the image forming job in order to execute the operation in the forced supply mode (S21). At this time, during the execution of the operation in the forced supply mode, the developing driving motor 28 is not stopped and is continuously driven rotationally. Then, from the remaining supply amount M(remain) calculated by the remaining supply amount calculating portion 1508, a forced supply number of times of rotation B(supply) of the supplying screw 32 is calculated by the following formula 9 at the unit supply amount calculating portion 1507 (S22).

$$B(\text{supply}) = M(\text{remain})/T \quad \text{(formula 8)}$$

Figure 11:
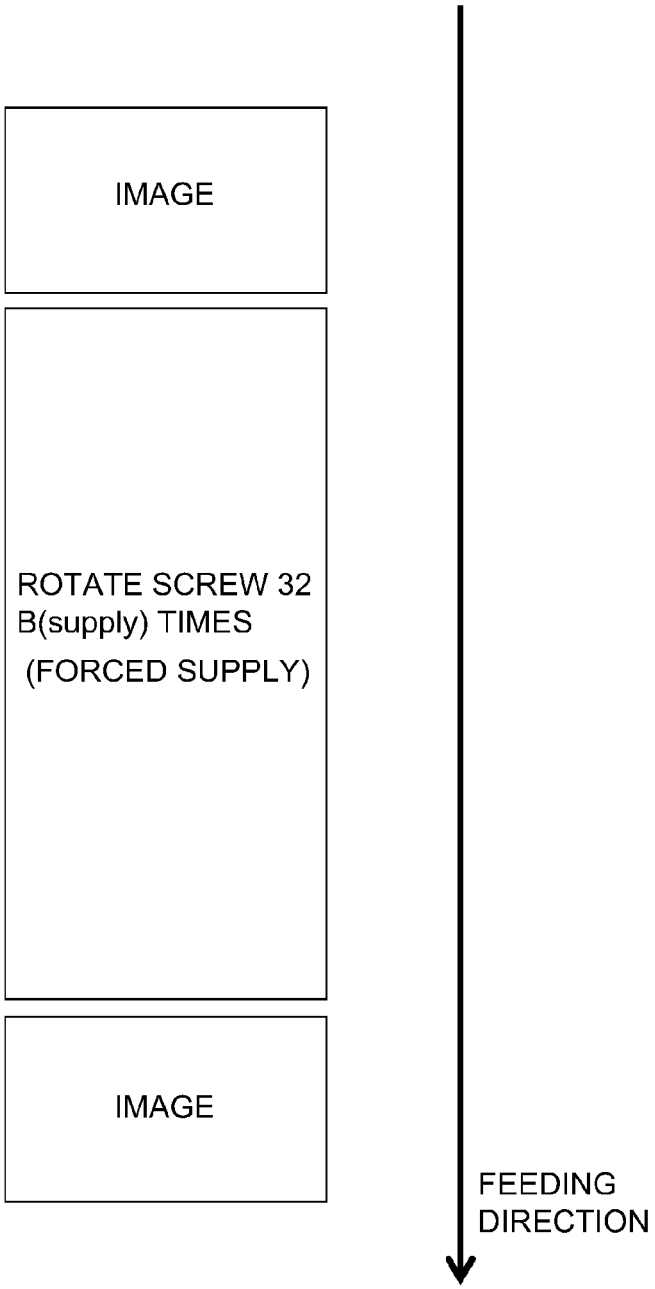
FIG. 11 is a schematic view for illustrating the operation in the forced supply mode in the embodiment.

Then, the CPU 206 provides notification to the supplying motor 33 so that the supplying screw 32 is rotated by the forced supply number of times of rotation B (supply), and the toner is supplied (S23). That is, when the operation in the forced supply mode is executed, the toner is supplied in the amount (corresponding to B(supply)) depending on the remaining supply amount M(remain) calculated by the remaining supply amount calculating portion 1508 immediately for the operation in the forced supply mode. Then, after the remaining supply amount M(remain) is calculated again (S24), the operation in the forced supply mode is ended, and then the image forming job is resumed. That is, in the case where the operation in the forced supply mode is executed, the toner supply amount calculating portion 1506 uses the re-calculated remaining supply amount M(remain) during the calculation of the toner supply amount for subsequent image formation. Specifically, from the remaining supply amount M(remain) calculated by the remaining supply amount calculating portion 1508 immediately before execution of the operation in the forced supply mode, the toner supply amount (corresponding to B (supply)) of the toner supplied in the operation in the forced supply mode is subtracted. Then, the value obtained by this subtraction is added during calculation of subsequent toner supply amount to calculate the toner supply amount M to be supplied to the developing device. Incidentally, FIG. 11 is a schematic view showing the case where the image forming job is interrupted and then the operation in the forced supply mode is executed and thereafter the image forming job is started again.

In controller of the above-described operation in the forced supply mode in Comparison Example, the following case will be considered. That is, the case where the "high-duty-black image chart" is formed on 5 sheets, and thereafter the "low-duty-black image chart" is formed on 5 sheets, i.e., an image forming job for effecting continuous image formation on 10 sheets in total is performed will be considered specifically. Here, the "high-duty-black image chart" is a chart such that the image is Y=5%, M=5%, C=5% and K=100% is formed on one surface of the A4-sized recording material. Further, the "low-duty-black image chart" is a chart such that the image of Y=5%, M=5%, C=5% and K=1% is formed on one surface of the A4-sized recording material.

As described above, the toner consumption at the image ratio (print ratio) of 100% is 0.35 g and is proportional to the print ratio. Accordingly, the toner consumption amount at the print ratio of 5% is 0.0175 g. Further, the maximum toner supply amount is 0.20 g, and therefore the toner supply amount is sufficient in the case of a low print ratio (5%), but is insufficient in the case where an image having a high print ratio (100%) is continuously outputted, so that the operation in the forced supply mode is executed under a predetermined condition.

Figure 12:
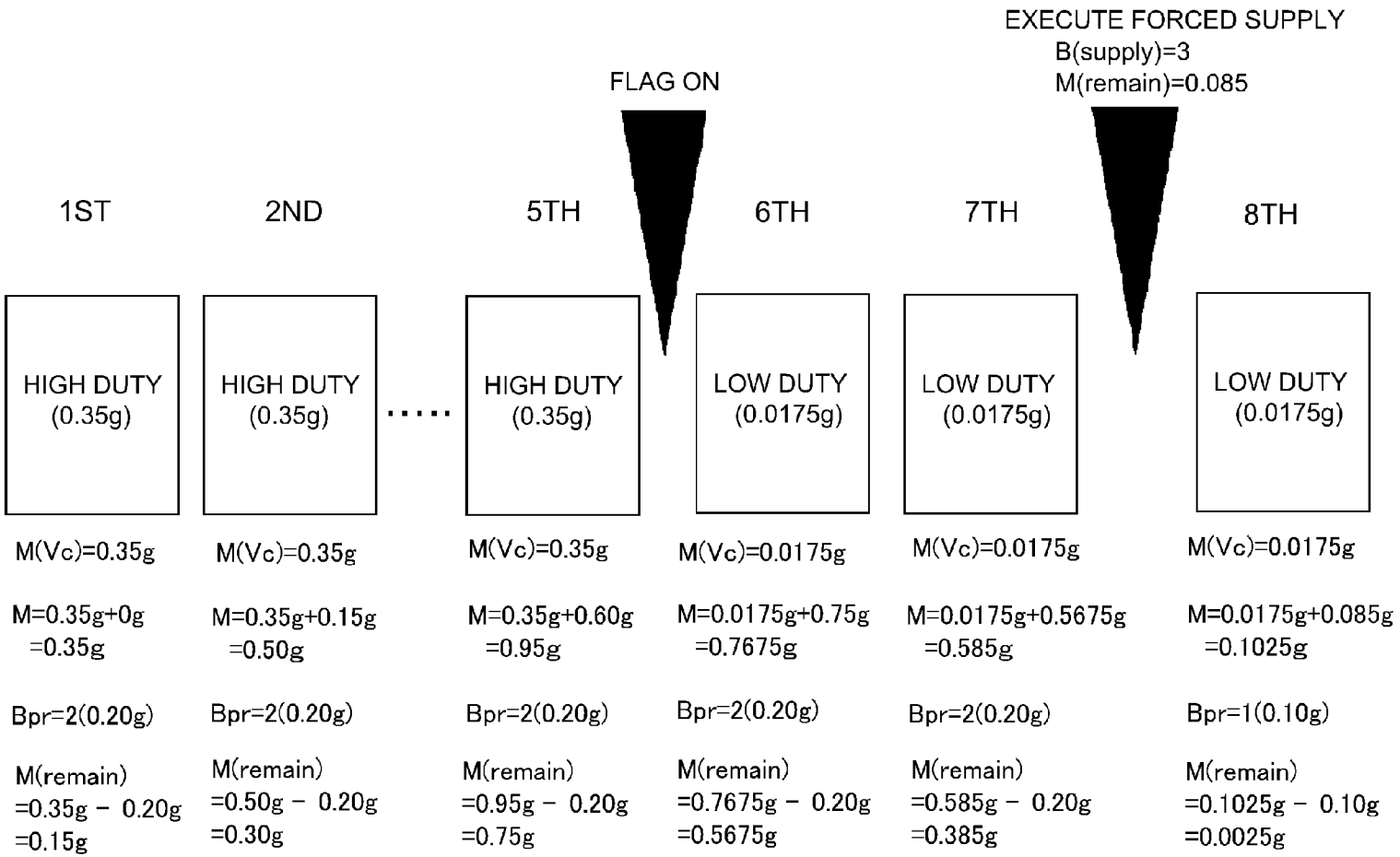
FIG. 12 is a schematic view showing a relationship among parameters in the case where supply controller is effected in Comparison Example.

Here, progression of the remaining supply amount M(remain) in the case where the above-described job (image formation on 10 sheets in total on one surface of the A4-sized recording material) is performed will be described using FIG. 12. In FIG. 12, all of numerical values are used for K (black). With respect to Y (yellow), M (magenta) and C (cyan), the print ratio is 5% which is low, and thus the operation in the forced supply mode is not executed. Therefore, values for these colors are not indicated in FIG. 12. For simplicity of description, the inductance supply amount M(Indc) is 0.

As shown in FIG. 12, during the image formation of the "high-duty-black image chart", the toner consumption amount per one sheet is 0.35 g, and therefore the video count supply amount M(Vc)=0.35 g. However, the actual toner supply amount is the amount corresponding to the maximum number of times of rotation Bpr=2 of the supplying screw 32, i.e., 0.20 g which is short by 0.15 g. Accordingly, during the image formation of the "high-duty-black image chart", the remaining supply amount M(remain) gradually integrates every by 0.15 g, thus monotonically increases. Then, at the 5-th sheet, the remaining supply amount M(remain) reaches 0.75 g, so that the remaining supply amount threshold M(supply) exceeds 0.70 g.

Figure 8:
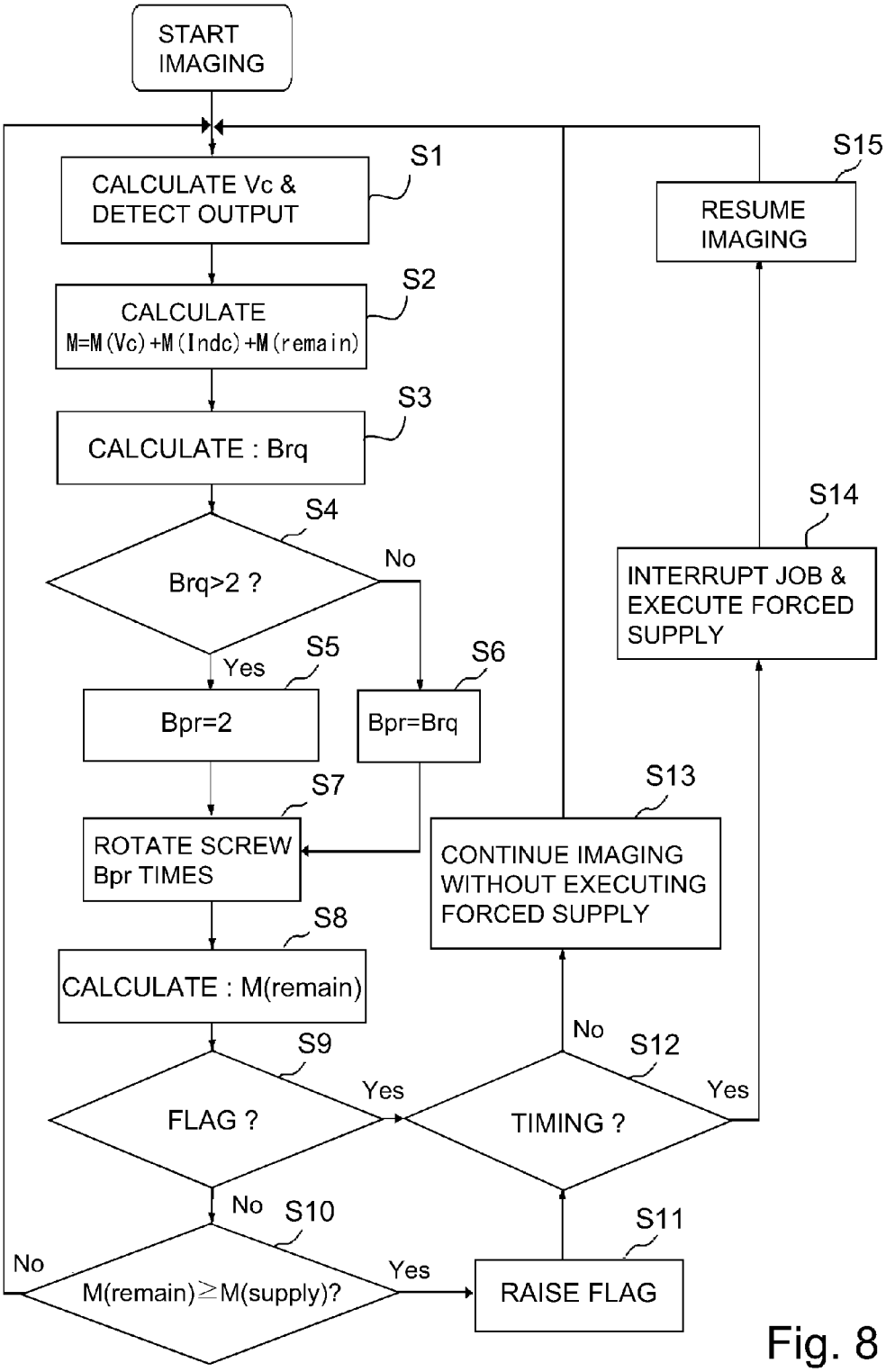
FIG. 8 is a flowchart for discriminating whether or not an operation in a forced supply mode in Comparison Example can be executed.

At this time, in accordance with the flowchart of FIG. 8, the forced supply flag is set (S10 and S11 in FIG. 8). However, as described above, there is a time lag of 2 sheets in the period from the raising of the forced supply flag until the operation in the forced supply mode is actually executed. For this reason, the operation in the forced supply mode is executed in actuality after the image formation of the "low-duty-black image chart" on the 7-th sheet is ended.

Here, from the 6-th sheet to the 10-th sheet, the image formation of the "low-duty-black image chart" is effected, and therefore during the image formation of the "low-duty-black image chart", the toner consumption amount per one sheet is 0.0175 g. In this case, the video count supply amount M(Vc)=0.0175 g. At the 6-th sheet, M=0.0175+0.75=0.7675 g, and therefore the toner is supplied in the maximum supply amount of 0.20 g. Then, the remaining supply amount M (remain) is 0.567 g. Then, at the 7-th sheet, M=0.0175+0.5675=0.585 g, and therefore the toner is supplied also in the maximum supply amount of 0.20 g. Then, the remaining supply amount M(remain) is 0.385 g. That is, at each of the 6-th sheet and the 7-th sheet after the 5-th sheet, the remaining supply amount M(remain) decreases by 0.1825 g. In addition, at the 6-th sheet and the later, the value of the remaining supply amount M(remain) is below the remaining supply amount threshold M(supply)=0.70 g which is a condition for executing the operation in the forced supply mode.

However, in Comparison Example, as described above with reference to FIG. 8, when the forced supply flag is set, the operation in the forced supply mode is executed irrespective of the toner consumption amount until the operation in the forced supply mode. For this reason, even when the value of the remaining supply amount M(remain) is below the remaining supply amount threshold M(supply) which is the condition for executing the operation in the forced supply mode, at the time of the end of the image formation on the 7-th sheet, the image forming job is once interrupted and then the operation in the forced supply mode is executed. The toner supply amount during the execution of the operation in the forced supply mode is B(supply)=0.385 g/0.10 g=3 (obtained by discarding the fractional portion), and therefore the toner in the amount of 0.30 g is supplied. As a result of this, the remaining supply amount M(remain) after the operation in the forced supply mode is executed is (0.385 g-0.30 g)=0.085 g, so that the image formation on the 8-th sheet and the later is resumed.

[Discrimination as to Whether or not Operation in Forced Supply Mode in this Embodiment can be Executed]

Next, a flow of discrimination as to whether or not the operation in the forced supply mode in this embodiment can be executed will be described using FIG. 13. The flow from S31 to S38 is the same as the flow from S1 to S8 in Comparison Example, and therefore description thereof will be omitted. Whether or not the remaining supply amount M(remain) calculated in the step S38 satisfies the relationship of the formula 7 is discriminated. That is, whether or not the difference (remaining supply amount M(remain)) calculated by the remaining supply amount calculating portion 1508 is not less than the predetermined threshold (not less than the remaining supply amount threshold M(supply)) is discriminated (S39). In the case where the formula 7 is satisfied, i.e., in the case where the remaining supply amount M(remain) is not less than the remaining supply amount threshold M(supply), the predetermined signal is stored in the RAM 211, i.e., the forced supply flag is set (S40).

Then, the CPU 206 discriminates whether or not the timing is predetermined timing when the operation in the forced supply mode is executable (S41). That is, similarly as in Comparison Example, even when the forced supply flag is set, in some cases, the operation in the forced supply mode after the image formation is interrupted cannot be executed immediately.

For example, in the case where the continuous image formation is in progress, when the forced supply flag for the developing device 104K for K is set, at the image forming station Y for Y, a subsequent image forming operation has already been continued in some cases. For this reason, even after the forced supply flag for K is set, a time lag generates in some cases until the operation in the forced supply mode is executed.

In the case of this embodiment, the video count is notified substantially simultaneously with timing of formation of the latent image for each color. Accordingly, the time lag is determined depending on how many sheets of the recording material enter a distance D from an exposure position (Y exposure position) on the photosensitive drum 101Y at the image forming station Y to an exposure position (K exposure position) on the photosensitive drum 101K at the image forming station K. Here, the distance D from the Y exposure position to the K exposure position is the sum of the following distances D1 to D3. D1 is a distance on the photosensitive drum 101Y from the Y exposure position to the primary transfer position (Y primary transfer position) on the photosensitive drum 101Y. D2 is a distance on the intermediary transfer belt 121 from the Y primary transfer position to the primary transfer position (K primary transfer position) on the photosensitive drum 101K. D3 is a distance on the photosensitive drum 101K from the K primary transfer position to the K exposure position. Then, in this distance D, depending on how may sheets of the recording material are subjected to the image formation, a maximum time lag generating from the raising of the supply execution flag until the operation in the forced supply mode is actually executed is determined. Accordingly, the predetermined timing when the operation in the forced supply mode is executable is immediately after image formation on a predetermined number of sheets corresponding to a size of the recording material to be subjected to the image formation is effected after the forced supply flag is set.

For example, in the case of this embodiment, at each of the image forming stations, the distance on the photosensitive drum from the exposure position to the primary transfer position is 45 mm, i.e., the same, and therefore D1 and D3 are 45 mm. Further, the distance D2 between the Y primary transfer position and the K primary transfer position is 285 mm. Accordingly, the distance D from the Y exposure position to the K exposure position is 375 mm. Here, in the case where the image formation on the A4-sized recording material (feeding direction length: 210 mm) is effected, when the forced supply flag for the developing device 104K is set, the image formation on the first sheet is ended and the image formation on the second sheet has already been effected partway at the image forming station Y. Accordingly, in order to prevent the Y toner or the like with which the image formation is started from being useless, the video count for K is notified and not only the forced supply flag is set but also the image formation of the associated image is completed. Then, after the image formation on at least 2 sheets is completed, the operation in the forced supply mode is executed. That is, in this embodiment, in a period from the raising of the forced supply flag until the operation in the forced supply mode is executed, there is a time lag corresponding to the image formation on 2 sheets of the A4-sized recording material. Accordingly, in the case where the continuous image formation on the A4-sized recording material is effected, the operation in the forced supply mode is executed immediately after the image formation on 2 sheets (predetermined corresponding number of sheets) after the forced supply flag for the developing device 104K is set.

Similarly, in the case where the image is formed on the A3-sized recording material (feeding direction length: 420 mm), when the forced supply flag for the developing device 104K is set, the image forming station Y has already effected subsequent image formation partway. Accordingly, the video count for K is notified, and not only the supply execution flag is set but also the image formation of the associated image is completed. Then, image formation on at least one sheet is completed and thereafter the operation in the forced supply mode is executed. That is, in this embodiment, in a period from the raising of the forced supply flag until the operation in the forced supply mode is executed, there is a time lag corresponding to image formation on one sheet of the A3-sized recording material. Accordingly, in the case where the continuous image formation on the A3-sized recording material is effected, after the forced supply flag for the developing device 104K is set, the operation in the forced supply mode is executed immediately after the image formation on one sheet (predetermined corresponding number of sheet). Similarly, in the case of an image (sheet) size smaller than the A4 size, in a period from the raising of the forced supply flag until the operation in the forced consumption mode is executed in actuality, the number of sheets subjected to the image formation increases.

However, a condition (predetermined timing) of the time lag from the raising of the forced supply flag until the operation in the forced supply mode is executed is not limited thereto. In the case where there is a constraint of communication between an image processing controller and an engine controller or there is another constraint that the recording material passes through the secondary transfer position, where the toner image is transferred from the intermediary transfer belt 121, with reliability and then the operation in the forced consumption mode is executed, the time lag condition is in accordance with these constraints. Further, in the case where the forced supply flag for the developing device for the color other than K, the time lag varies depending on the position of the forced supply flag. That is, the time lag becomes smaller with the position of the image forming station closer to an upstream with respect to the rotational direction of the intermediary transfer belt 12. Accordingly, depending on the image forming station for which the forced supply flag is set, the predetermined timing may also be changed or made uniformly the same.

In the step S41, if the timing is timing (predetermined timing) when the operation in the forced supply mode is executable is checked, and if the timing is the predetermined timing, the image formation is interrupted and then the operation in the forced consumption mode is executed (S43). That is, in the case where the forced supply flag is still set (the predetermined signal is stored in the RAM 211) at the predetermined timing after the forced supply flag is set (after the predetermined signal is stored in the RAM 211), the image forming job is interrupted and then the operation in the forced supply mode is executed. The toner supply amount at this time is the remaining supply amount M(remain) at the time when the operation in the forced supply mode is actually executed. That is, when the operation in the forced supply mode is executed, the toner in the remaining supply amount M(remain) calculated immediately before the execution of the operation in the forced supply mode is supplied. The operation in the forced supply mode is similar to that described above with reference to FIG. 9. When the operation in the forced supply mode is executed in the step S43, the image formation is resumed (S44).

On the other hand, if the timing is not the predetermined timing when the operation in the forced consumption mode is executable in the step S41, the operation in the forced supply mode is not executed, and the image formation is continued while maintaining the remaining supply amount M(remain) as it is (S42). Then, in subsequent image formation, S31 to S39 are repeated. In the case where an image having a low print ratio is formed in a period from the raising of the forced supply flag to the predetermined timing when the operation in the forced supply mode is executable, there is a possibility that the formula 7 is not satisfied in S39. That is, in a period from the raising of the forced supply flag to the execution timing of the operation in the forced supply mode, there is a possibility that the difference (remaining supply amount M(remain)) calculated by the remaining supply amount is less than the predetermined threshold (less than the remaining supply amount threshold M(supply)). Therefore, in this embodiment, in the case where the formula 7 is not satisfied in S39, the forced supply discriminating portion 1509 as a canceling means lowers the forced supply flag and thus cancels the operation in the forced supply mode (S45). That is, the forced supply discriminating portion 1509 cancels the predetermined signal stored in the RAM 211. In other words, it is assumed that the remaining supply amount M becomes less than the remaining supply amount threshold M by the image formation in a period from the time when the remaining supply amount M(remain) becomes the remaining supply amount threshold M(supply)) (i.e., after the predetermined signal is stored in the RAM 211) to the predetermined timing. In this case, the operation in the forced supply mode at the predetermined timing is interrupted. Thereafter, the operation in the forced supply mode is not executed, and the image formation is continued (S46).

Incidentally, in the case where after the forced supply flag is set in S40, the image formation is continued at timing which is not the predetermined timing when the operation in the forced supply mode is executable, there is also a possibility that the image having the high print ratio is formed again and in S39, the formula 7 is still satisfied. In this case, the forced supply flag is still set at the forced supply discriminating portion 1509. Then, in S41, in the case where the timing is the execution timing of the operation in the forced supply mode, the image formation is once stopped, and then the operation in the forced supply mode is executed (S43). That is, even when the image formation is effected after the forced supply flag is set, in the case where the forced supply flag is still set at the predetermined timing, the image forming job is interrupted and then the operation in the forced supply mode is executed. Thereafter, the remaining supply amount M(remain) is calculated again, and then the image formation is resumed (S44).

When the forced supply flag is set, the image forming apparatus prepares for the interruption of the image forming job at the predetermined timing, so that the sequence goes to an operation for interrupting the image formation successively from the upstreammost image forming station Y. When the forced supply flag is reset before the image formation at the image forming station Y is stopped, the preparatory operation for interrupting the image forming job is stopped, so that the image formation is continued without lowering the productivity. In the case where the timing when the forced supply flag is reset is close to the predetermined timing when the operation in the forced supply mode is executed and the image formation at the image forming station Y is interrupted, although the operation in the forced supply mode is not executed, but the operation in the forced supply mode is not executed, the sheet interval is increased. Also in that case, compared with Comparison Example, the productivity is kept at a high level. In this embodiment, the interruption of the image forming job refers to that the sheet interval is made broader than the sheet interval set in advance depending on the species of paper (recording material) or the like.

In this embodiment, the predetermined timing when the operation in the forced supply mode is executable is set at timing immediately after the image formation on the predetermined number of sheets depending on the size of the recording material, e.g., 2 sheets of the A4-sized recording material, after the forced supply flag is set. However, in the case where this predetermined timing is during the image formation on final several sheets in the image forming job, even when final image formation is effected without executing the operation in the forced consumption mode after the image formation is intendedly interrupted, the influence thereof on the image quality is little in some cases. Accordingly, in such a case, after the final image formation is ended, the operation in the forced consumption mode may also be executed. That is, the number of sheets from the raising of the forced supply flag until the final image in the image forming job is formed and the number of sheets from the raising of the forced supply flag to the predetermined timing are compared with each other, and then the predetermined timing when the operation in the forced supply mode is executed in actuality may also be adjusted.

In other words, the predetermined timing is immediately after the final image in the image forming job is formed in the case where the number of sheets from the raising of the forced supply flag to the end of the image forming job is more than a predetermined corresponding number and is not more than a certain number. Here, the predetermined corresponding number is, e.g., 2 sheets of the A4-sized recording material as described above, and the certain number is a value set so as to be larger than the predetermined corresponding number and is, e.g., 5 sheets of an A4-sized recording material. The certain number is set to such a number that the influence thereof on the image quality is little even when the image formation is interrupted and then the final image formation is effected without executing the operation in the forced supply mode.

Specific description will be made. First, it is assumed that the number of sheets from the raising of the forced supply flag to the end of the image forming job is 3 sheets and the predetermined corresponding number of sheets from the raising of the forced supply flag to the execution of the operation in the forced supply mode is 2 sheets. In this case, the operation in the forced supply mode is executed after the image formation on remaining 3 sheets in the image forming job is ended, not immediately after the image formation on 2 sheets after the supply execution flag is set. That is, depending on a remaining number of sheets in the image forming job, the timing of execution of the operation in the forced supply mode is executed may also be delayed.

[Specific Example of Operation in Forced Supply Mode in this Embodiment]

In controller of the above-described operation in the forced supply mode in this embodiment, similarly as in Comparison Example, the following case will be considered. That is, the case where the "high-duty-black image chart" is formed on 5 sheets, and thereafter the "low-duty-black image chart" is formed on 5 sheets, i.e., an image forming job for effecting continuous image formation on 10 sheets in total is performed will be considered specifically. Similarly as in Comparison Example, the "high-duty-black image chart" is a chart such that the image is Y=5%, M=5%, C=5% and K=100% is formed on one surface of the A4-sized recording material. Further, the "low-duty-black image chart" is a chart such that the image of Y=5%, M=5%, C=5% and K=1% is formed on one surface of the A4-sized recording material.

As described above, the toner consumption at the image ratio (print ratio) of 100% is 0.35 g and is proportional to the print ratio. Accordingly, the toner consumption amount at the print ratio of 5% is 0.0175 g. Further, the maximum toner supply amount is 0.20 g, and therefore the toner supply amount is sufficient in the case of a low print ratio (5%), but is insufficient in the case where an image having a high print ratio (100%) is continuously outputted, so that the operation in the forced supply mode is executed under a predetermined condition.

Figure 14:
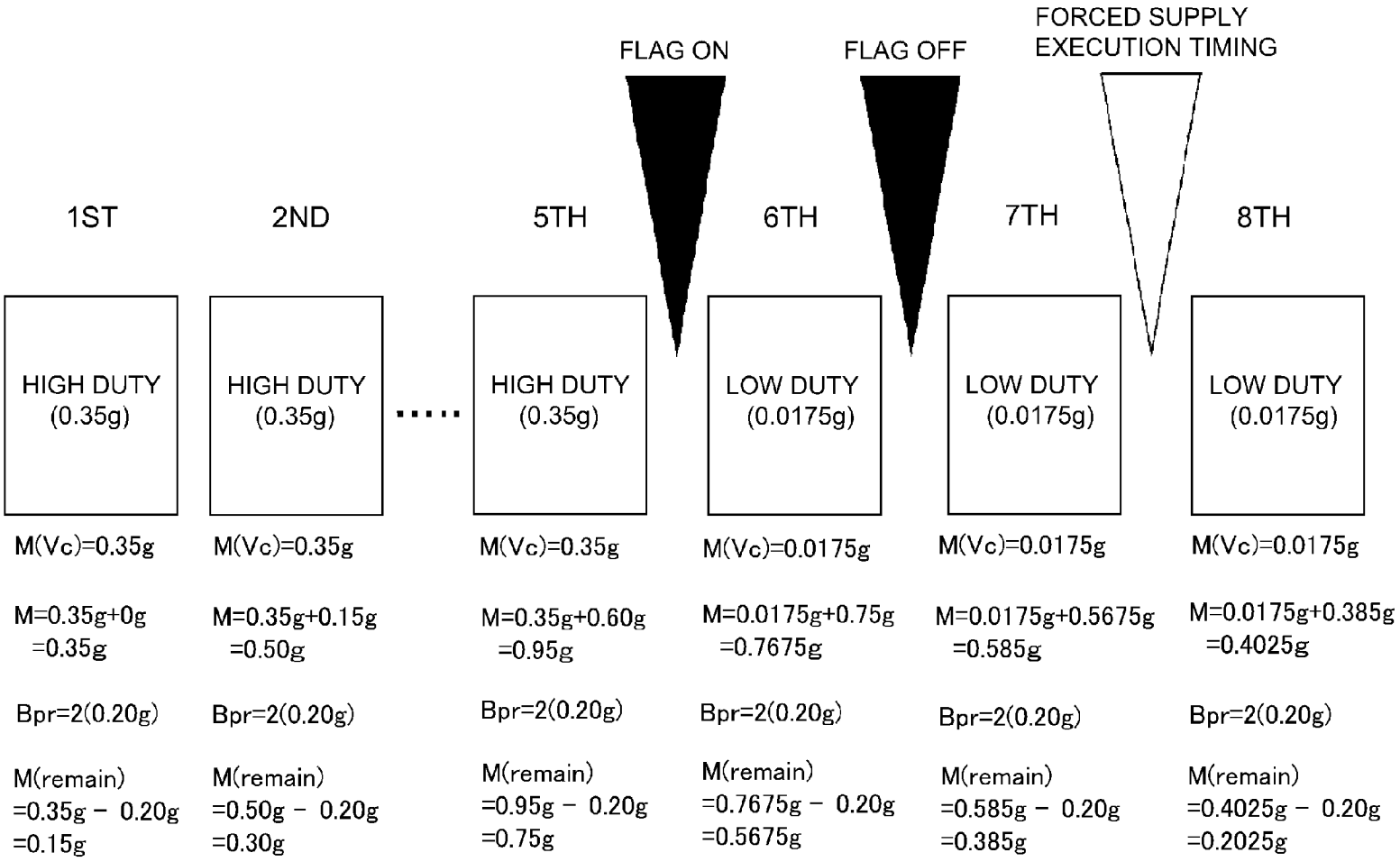
FIG. 14 is a schematic view showing a relationship among parameters in the case where the supply controller is effected in the embodiment.

Here, progression of the remaining supply amount M(remain) in the case where the above-described job (image formation on 10 sheets in total on one surface of the A4-sized recording material) is performed will be described using FIG. 14. In FIG. 14, all of numerical values are used for K (black). With respect to Y (yellow), M (magenta) and C (cyan), the print ratio is 5% which is low, and thus the operation in the forced supply mode is not executed. Therefore, values for these colors are not indicated in FIG. 12. For simplicity of description, the inductance supply amount M(Indc) is 0.

As shown in FIG. 14, during the image formation of the "high-duty-black image chart", the toner consumption amount per one sheet is 0.35 g, and therefore the video count supply amount M(Vc)=0.35 g. However, the actual toner supply amount is the amount corresponding to the maximum number of times of rotation Bpr=2 of the supplying screw 32, i.e., 0.20 g which is short by 0.15 g. Accordingly, during the image formation of the "high-duty-black image chart", the remaining supply amount M(remain) gradually integrates every by 0.15 g, thus monotonically increases. Then, at the 5-th sheet, the remaining supply amount M(remain) reaches 0.75 g, so that the remaining supply amount threshold M(supply) exceeds 0.70 g.

Figure 13:
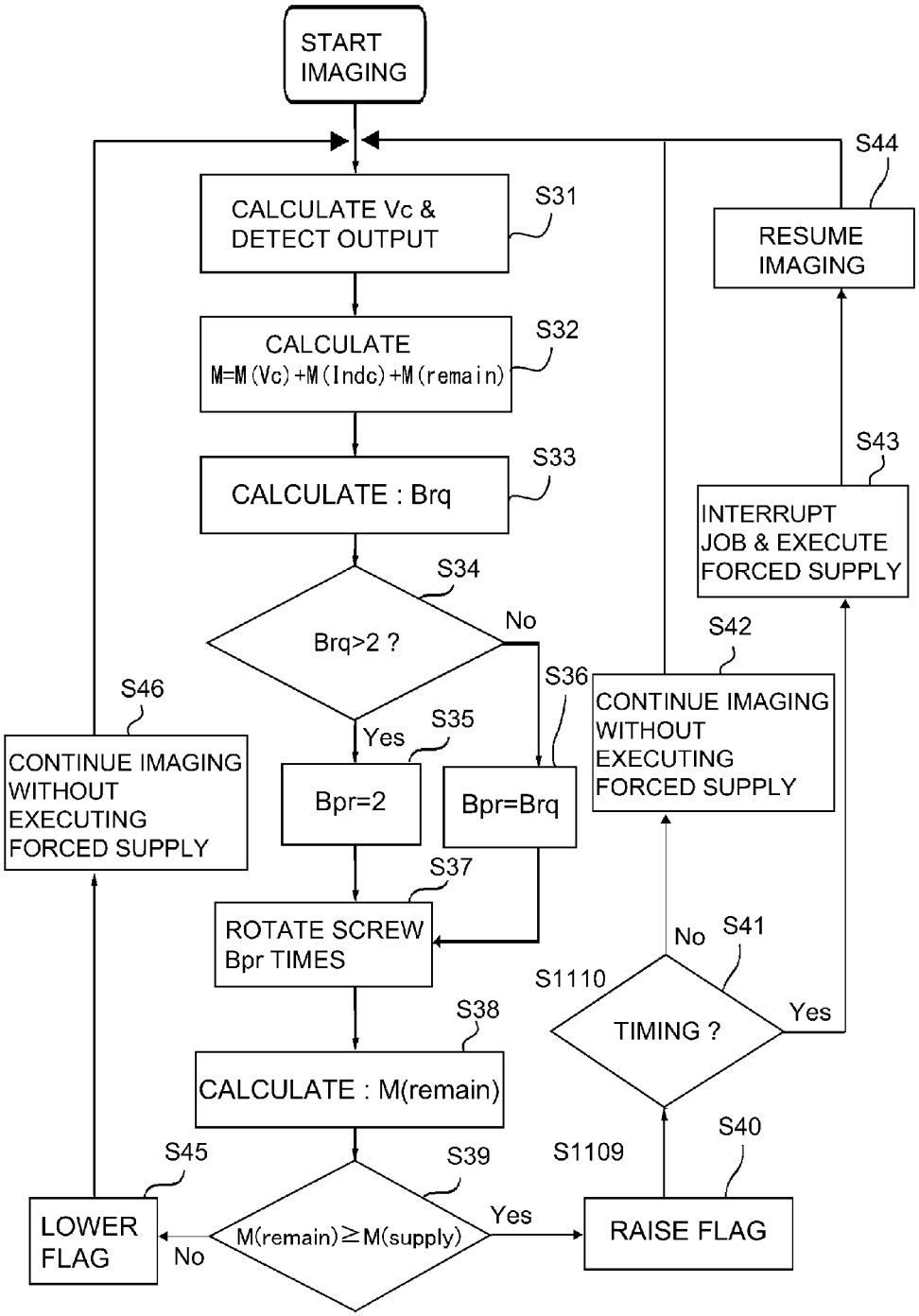
FIG. 13 is a flowchart showing for discriminating whether or not the operation in the forced supply mode in the embodiment can be executed.

At this time, in accordance with the flowchart of FIG. 13, the forced supply flag is set (S39 and S40 in FIG. 13). However, as described above, there is a time lag of 2 sheets in the period from the raising of the forced supply flag until the operation in the forced supply mode is actually executed. For this reason, the predetermined timing when the operation in the forced supply mode is executed is after the image formation of the "low-duty-black image chart" on the 7-th sheet is ended.

Here, in this embodiment, the calculation of the remaining supply amount M(remain) is continuously updated (made) also during this time lag, and in the case where the image having the low image ratio is formed until the timing of the 7-th sheet which is the timing when the operation in the forced supply mode is executed, the forced supply flag is reset. That is, from the 6-th sheet to the 10-th sheet, the image formation of the "low-duty-black image chart" is effected, and therefore during the image formation of the "low-duty-black image chart", the toner consumption amount per one sheet is 0.0175 g. In this case, the video count supply amount M(Vc)=0.0175 g. At the 6-th sheet, M=0.0175+0.75=0.7675 g, and therefore the toner is supplied in the maximum supply amount of 0.20 g. Then, the remaining supply amount M(remain) is 0.5675 g. That is, after the 6-th sheet and the later, the remaining supply amount M(remain) decreases by 0.1825 g. As a result, by the image formation on the 6-th sheet, the value of the remaining supply amount M(remain) is below the remaining supply amount threshold M(supply)=0.70 g which is a condition for executing the operation in the forced supply mode. For this reason, in this embodiment, the forced supply flag is reset at this time. As a result, at the time of an end of the image formation on the 7-th sheet which was the timing when the operation in the forced supply mode is executed, the operation in the forced supply mode is not executed in actuality. In addition, also the image forming job is not interrupted, and subsequently the image formation of the "low-duty-black image chart" on the 8-th sheet is executed.

Further, this embodiment is described as follows with use of the example of FIG. 14 described above. First, the case where the image formation on a predetermined number of sheets (8 sheets) is effected at a first image ratio (high-duty-black image chart) will be considered. In this case, the forced supply flag is set at the time of end of the image formation on the 5-th sheet, and the operation in the forced supply mode is executed at the time of end of the image formation on the 7-th sheet. On the other hand, the case where the image formation on the predetermined number of sheets (8 sheets) is effected at the first image ratio and a second image ratio (low-duty-black image chart) in combination. In this case, assuming that the image formation on the first sheet to the 5-th sheet is effected at the first image ratio (high-duty-black image chart) and the image formation on the 6-th sheet and the later is effected at the second image ratio (low-duty-black image chart), the forced supply flag is set at the time of end of the image formation on the 5-th sheet but is reset at the time of end of the image formation on the 6-th sheet, so that the operation in the forced supply mode is not executed. Accordingly, in the case of this embodiment, the frequency of the execution of the operation in the forced supply mode in the case where the image formation on the predetermined number of sheets is effected at the first image ratio and the second image ratio in combination is lower than that in the case where the image formation on the predetermined number of sheets is effected at the first image ratio.

[Comparison Between this Embodiment and Comparison Example]

Figure 15:
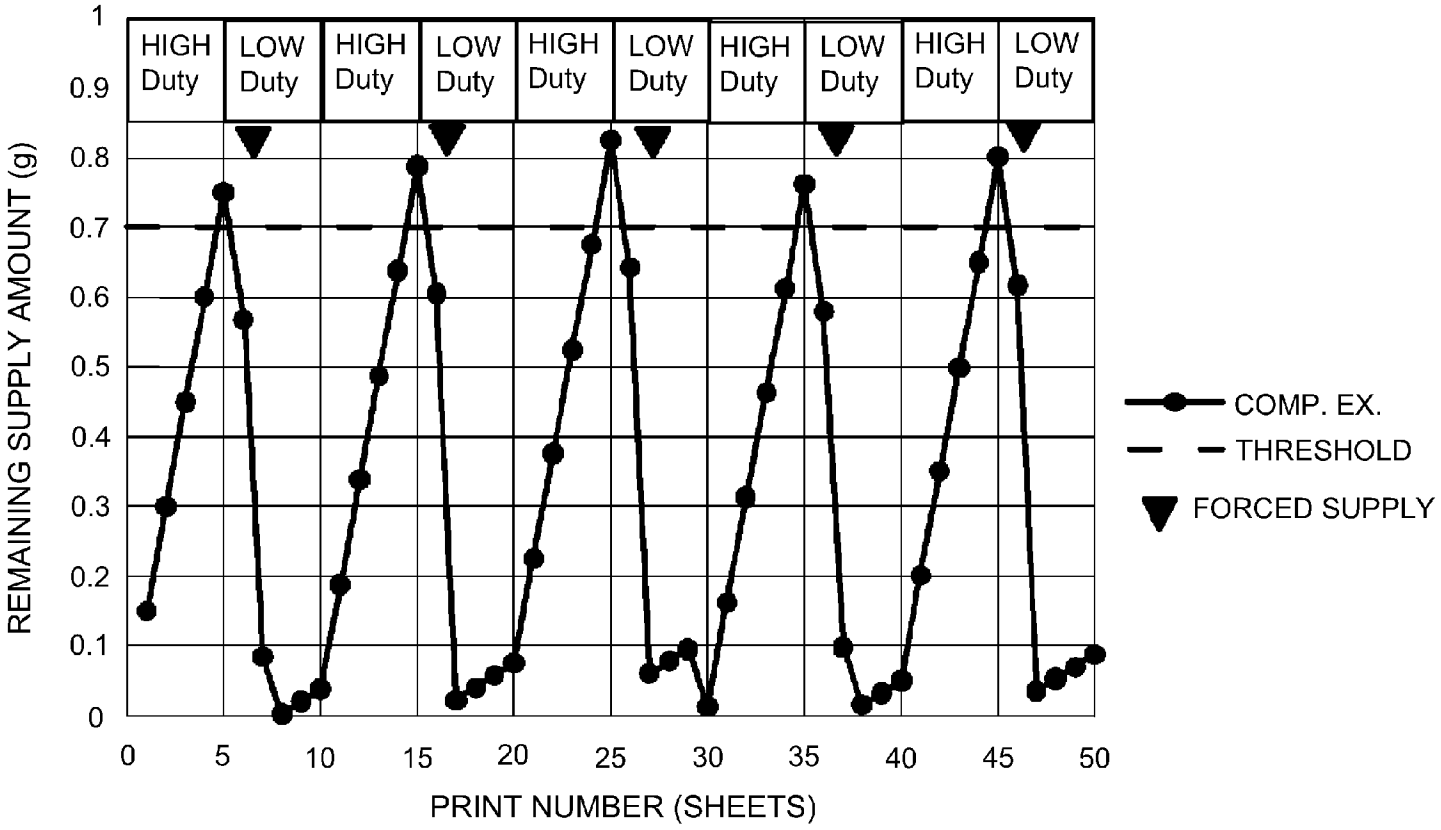
FIG. 15 is a table showing a relationship between the number of sheets subjected to image formation and a remaining supply amount in the case where the supply controller in Comparison Example is effected.
Figure 16:
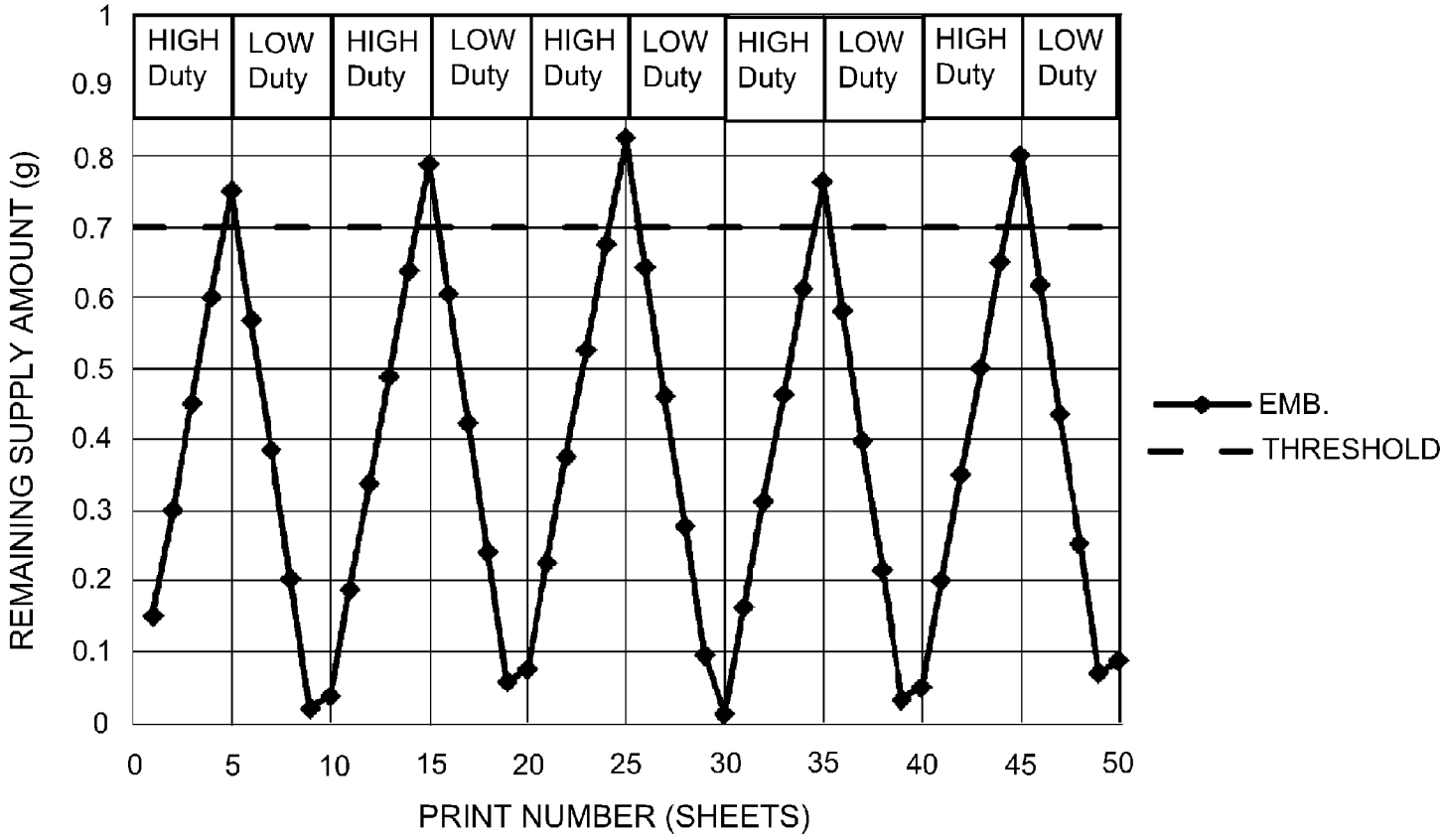
FIG. 16 is a table showing a relationship between the number of sheets subjected to image formation and a remaining supply amount in the case where the supply controller in the embodiment is effected.
Figure 17:
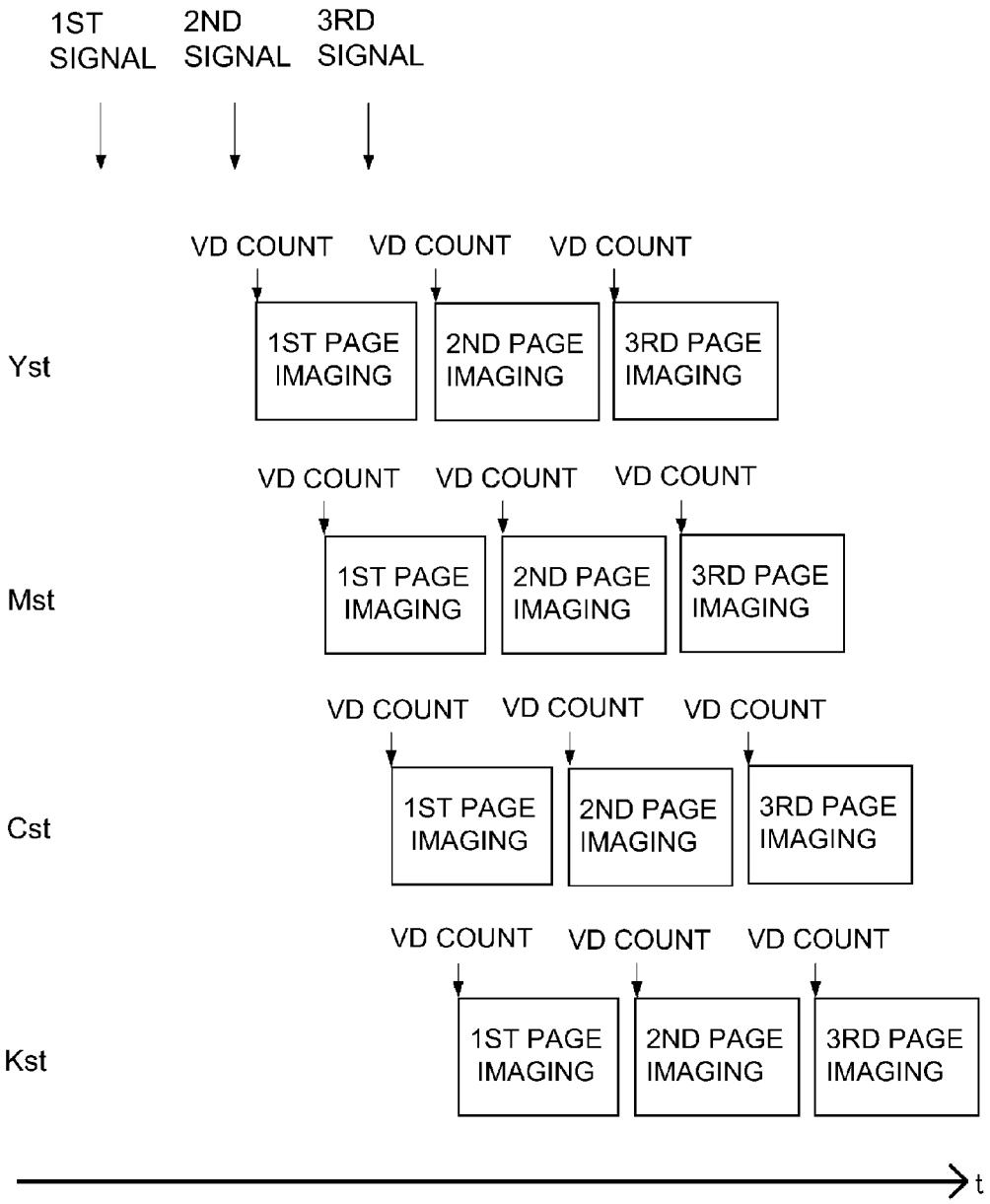
FIG. 17 is a schematic view showing image formation timing and notification timing of each of various signals from a controller.

With respect to the case where an image forming job for effecting continuous image formation on 50 sheets in total including 5 cycles each consisting of the image formation on 5 sheets of the "high-duty-black image chart" and the image formation of 5 sheets of the "low-duty-black image chart", this embodiment and Comparison Example will be compared with each other. FIGS. 15 and 16 are graphs in Comparison Example and this embodiment, respectively, each showing progression of the remaining supply amount M(remain) and timing when the operation in the forced supply mode is executed. Incidentally, this embodiment is a specific example in which the image forming job is carried out by the controller in this embodiment.

First, FIG. 15 shows the progression of the remaining supply amount M(remain) and the timing when the operation in the forced supply mode is performed in Comparison Example. In the case where the high-duty-black image chart is continued, the remaining supply amount M(remain) exceeds the remaining supply amount threshold M(supply) at the 5-th sheet. Then, although the remaining supply amount M(remain) gradually lowers by the low-duty-black image chart, the operation in the forced supply mode is executed at the 7-th sheet. Accordingly, the remaining supply amount M(remain) after the end of the image formation on the 7-th sheet (supply of 0.20 g) and the execution of the operation in the forced supply mode (supply of 0.30 g) is not more than 0.085 g. In Comparison Example, such a step is repeated, and therefore the operation in the forced supply mode is executed at the second sheet after the end of the image formation on the high-duty-black image chart. Accordingly, in the case where the image forming job as described above is executed, the number of times of execution of the operation in the forced supply mode is 5 times (a total number of times of rotation of the supplying screw: 17 times), so that a downtime of 17 sec generates and thus productivity lowers.

On the other hand, in this embodiment shown in FIG. 16, during a time lag from the raising of the forced supply flag to the timing when the operation in the forced supply mode, in the case where the remaining supply amount M(remain) is below the remaining supply amount threshold M(supply), the forced supply flag is reset. For this reason, in actuality, the operation in the forced supply mode is not executed. Accordingly, even in the case where the above-described image forming job is executed, the number of times of execution of the operation in the forced supply mode is zero, so that the productivity does not lower.

As described above, according to this embodiment, in the constitution capable of executing the operation in the forced supply mode, the lowering in productivity due to the execution of the operation in the forced supply mode can be suppressed while maintaining an image quality. That is, even when the forced supply flag is set, in the case where the remaining supply amount M(remain) is below the remaining supply amount threshold M(supply) until the predetermined timing when the operation in the forced supply mode is executed, the forced supply flag is reset. For this reason, the execution of the operation in the forced supply mode more than necessary can be suppressed, and thus the lowering in productivity can be suppressed.

[Other Embodiments]

The downtime-reducing effective varies depending on constitutions (value sheet number, intermittent number of sheets, sheet size, image duty, one-side/double-side, process speed, etc.) of the print job. The time lag from the raising of the forced supply flag to the actual execution of the operation in the forced supply mode also varies depending on the constitutions of the image forming apparatus. For example, as shown in FIG. 14, depending on the feeding enabling signal timing and the yellow image formation timing, the time lag generates also in the execution of the operation in the forced supply mode of the yellow toner. Incidentally, the "unit sheet number" is the number of sheets subjected to image formation in one image forming job. Accordingly, in the above, the description is made using an example in which the effect of the present invention is easy to understand.

Further, in the above description, the constitution in which the supplying motor is provided for each of the toner supplying devices was described, but the present invention is also applicable to the constitutions disclosed in JP-A 2006-201314 and JP-A 2011-48201 which are described above. Specifically, the present invention may also be preferably applicable to a constitution in which a single supplying motor is provided for the toner supplying devices for two colors and a driving path from the supplying motor to the supplying screw of the toner supplying device is switched. In the case of this constitution, the toner supply from the toner supplying devices for the two colors is made while switching the driving path of the single supplying motor, and therefore the frequency of execution of the toner supply for one color during the image forming job lowers. For this reason, it would be considered that the case where the toner supply amount is insufficient by the toner supply during the image forming job is liable to generate and thus the forced supply flag is also liable to be set. Accordingly, in such a case, when the above-described controller as in Comparison Example is effected, the operation in the forced supply mode is easily executed frequently, so that there is a possibility that the productivity largely lowers. On the other hand, when the controller in the present invention as described above is effected in this constitution, it is possible to suppress the execution of the operation in the forced supply mode more than necessary, and therefore the lowering in productivity can be suppressed.

According to the present invention, in the constitution capable of executing the operation in the forced supply mode, while maintaining the image quality, the lowering in productivity due to the execution of the operation in the forced supply mode can be suppressed.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-252133 filed on Dec. 12, 2014, which is hereby incorporated by reference herein in its entirety.

What is claimed is:

1. An image forming apparatus comprising:

an image bearing member;

a developing device configured to develop an electrostatic latent image, formed on said image bearing member, with a toner;

a supplying device configured to supply the toner to said developing device; and a controller configured to control supply of the toner by said supplying device, wherein said controller is further configured for executing an operation in a supply mode and an operation in a forced supply mode, wherein in the supply mode, during a continuous image forming job for forming images on a plurality of recording materials continuously, said supplying device supplies the toner to said developing device without interrupting the image forming job, and wherein in the forced supply mode, during the continuous image forming job, when a toner amount in said developing device reaches a predetermined amount irrespective of supply of the toner in the operation in the supply mode, said supplying device supplies the toner after interrupting the image forming job, wherein said controller sets a flag for executing the operation in the forced supply mode when the toner amount reaches the predetermined amount during the continuous image forming job, and makes the following determination:

(i) in a case where a state in which the toner amount reaches the predetermined amount is eliminated when the images are formed on a predetermined number of the recording materials after the flag is set, the flag is reset, (ii) in a case where the state in which the toner amount reaches the predetermined amount is maintained when the images are formed on the predetermined number of the recording materials after the flag is set, said controller executes the operation in the forced supply mode, and (iii) when the image forming job is ended before the images are formed on the predetermined number of the recording materials after the flag is set, said supplying device supplies the toner after image formation is ended.

2. An image forming apparatus according to claim 1, wherein the predetermined number is changed depending on a size of the recording materials subjected to the image formation.

3. An image forming apparatus according to claim 1, further comprising a toner content detecting portion configured to detect a toner content in said developing device, wherein the supply amount of the toner to be supplied to said developing device is determined on the basis of an amount of the toner consumed every predetermined unit of the image formation, a detection result of said toner content detecting portion and a remaining supply amount of the toner which cannot be supplied in a last supplying operation and which remains in said supplying device.

4. An image forming apparatus according to claim 1, wherein said controller includes, a calculating portion configured to calculate the supply amount of the toner to be supplied to said developing device, wherein in a case where the supply amount of the toner calculated by said calculating portion is not more than a predetermined amount, said controller supplies the toner in the calculated supply amount to said developing device, and in a case where the supply amount of the toner calculated by said calculating portion is more than the predetermined amount, said controller supplies the toner in the predetermined amount to said developing device.

5. An image forming apparatus according to claim 4, wherein said calculating portion calculates the supply amount of the toner on the basis of a consumption value depending on an amount of the toner consumed every predetermined unit of the image formation.

6. An image forming apparatus according to claim 5, wherein in said developing device, a developer containing the toner and a carrier, wherein said image forming apparatus further comprises, a toner content detecting portion configured to detect a toner content in said developing device, and a toner content difference calculating portion configured to calculate a toner content difference between a toner content detected by said toner content detecting portion and a target value, and wherein said calculating portion calculates the supply amount of the toner by adding a value depending on the toner content difference calculated by said toner content difference calculating portion to a value depending on the consumption value.

7. An image forming apparatus according to claim 4, wherein when the operation in the forced supply mode is not executed, said calculating portion calculates the supply amount of the toner to be supplied to said developing device by adding the difference calculated by said difference calculating portion during subsequent calculation of the supply amount of the toner.

8. An image forming apparatus according to claim 4, wherein said controller causes said supplying device to supply the toner in an amount depending on the difference calculated by said difference calculating portion immediately before the operation in the forced supply mode is executed.

9. An image forming apparatus according to claim 8, wherein when the operation in the forced supply mode is executed, said calculating portion calculates the supply amount of the toner to be supplied to said developing device by adding, during subsequent calculation of the supply amount of the toner, a value obtained by subtracting a supply amount of the toner supplied in the operation in the forced supply mode from the difference calculated by said difference calculating portion immediately before the operation in the forced supply mode is executed.

10. An image forming apparatus comprising:

an image bearing member;

a developing device configured to develop an electrostatic latent image, formed on said image bearing member, with a toner;

a supplying device configured to supply the toner to said developing device; and a controller configured to control supply of the toner by said supplying device, wherein said controller is capable of executing an operation in a supply mode in which during a continuous image forming job for forming images on a plurality of recording materials continuously, said supplying device supplies the toner to said developing device without interrupting the image forming job and an operation in a forced supply mode in which during the continuous image forming job, when a toner amount in said developing device reaches a predetermined amount irrespective of supply of the toner in the operation in the supply mode, said supplying device supplies the toner after interrupting the image forming job;

wherein said controller sets a flag for executing the operation in the forced supply mode when the toner amount reaches the predetermined amount during the continuous image forming job, and makes the following determination:

(i) in a case where a state in which the toner amount reaches the predetermined amount is eliminated when the images are formed in a predetermined period after the flag is set, the flag is reset, (ii) in a case where the state in which the toner amount reaches the predetermined amount is maintained when the images are formed in the predetermined period after the flag is set, said controller executes the operation in the forced supply mode, and (iii) when the image forming job is ended before the images are formed in the predetermined period after the flag is set, said supplying device supplies the toner after image formation is ended.

11. An image forming apparatus according to claim 10, wherein the predetermined period is changed depending on a size of the recording materials subjected to the image formation.

12. An image forming apparatus according to claim 10, further comprising a toner content detecting portion configured to detect a toner content in said developing device, wherein the supply amount of the toner to be supplied to said developing device is determined on the basis of an amount of the toner consumed every predetermined unit of the image formation, a detection result of said toner content detecting portion and a remaining supply amount of the toner which cannot be supplied in a last supplying operation and which remains in said supplying device.

13. An image forming apparatus according to claim 10, wherein said controller includes, a calculating portion configured to calculate the supply amount of the toner to be supplied to said developing device, wherein in a case where the supply amount of the toner calculated by said calculating portion is not more than a predetermined amount, said controller supplies the toner in the calculated supply amount to said developing device, and in a case where the supply amount of the toner calculated by said calculating portion is more than the predetermined amount, said controller supplies the toner in the predetermined amount to said developing device.

14. An image forming apparatus according to claim 13, wherein said calculating portion calculates the supply amount of the toner on the basis of a consumption value depending on an amount of the toner consumed every predetermined unit of the image formation.

15. An image forming apparatus according to claim 14, wherein in said developing device, a developer containing the toner and a carrier, wherein said image forming apparatus further comprises, a toner content detecting portion configured to detect a toner content in said developing device, and a toner content difference calculating portion configured to calculate a toner content difference between a toner content detected by said toner content detecting portion and a target value, and wherein said calculating portion calculates the supply amount of the toner by adding a value depending on the toner content difference calculated by said toner content difference calculating portion to a value depending on the consumption value.

16. An image forming apparatus according to claim 13, wherein when the operation in the forced supply mode is not executed, said calculating portion calculates the supply amount of the toner to be supplied to said developing device by adding the difference calculated by said difference calculating portion during subsequent calculation of the supply amount of the toner.

17. An image forming apparatus according to claim 13, wherein said controller causes said supplying device to supply the toner in an amount depending on the difference calculated by said difference calculating portion immediately before the operation in the forced supply mode is executed.

18. An image forming apparatus according to claim 17, wherein when the operation in the forced supply mode is executed, said calculating portion calculates the supply amount of the toner to be supplied to said developing device by adding, during subsequent calculation of the supply amount of the toner, a value obtained by subtracting a supply amount of the toner supplied in the operation in the forced supply mode from the difference calculated by said difference calculating portion immediately before the operation in the forced supply mode is executed.

* * * * *